US011970832B2

(12) United States Patent
Degen et al.

(10) Patent No.: US 11,970,832 B2
(45) **Date of Patent: *Apr. 30, 2024**

(54) VIBRATOR ASSEMBLY FOR CREATING STONE COLUMNS, AND METHOD FOR CREATING STONE COLUMNS

(71) Applicants: Alexander Degen, Schwindegg (DE); Wilhelm Degen, Dubai (AE)

(72) Inventors: Alexander Degen, Schwindegg (DE); Wilhelm Degen, Dubai (AE)

( * ) Notice: Subject to any disclaimer, the term of this patent is extended or adjusted under 35 U.S.C. 154(b) by 0 days.

This patent is subject to a terminal disclaimer.

(21) Appl. No.: 17/979,927

(22) Filed: Nov. 3, 2022

(65) Prior Publication Data

US 2023/0121538 A1 Apr. 20, 2023

Related U.S. Application Data

(63) Continuation of application No. 17/215,054, filed on Mar. 29, 2021, now abandoned, which is a continuation of application No. 16/317,604, filed as application No. PCT/EP2017/068033 on Jul. 17, 2017, now Pat. No. 10,961,678.

(30) Foreign Application Priority Data

Jul. 15, 2016 (DE) ..... 102016113140.7

(51) Int. Cl.

| | |
|---|---|
| ***E02D 3/054*** | (2006.01) |
| ***E02D 3/08*** | (2006.01) |
| ***E02D 5/66*** | (2006.01) |
| ***E02D 7/18*** | (2006.01) |
| ***E02D 11/00*** | (2006.01) |
| ***E02D 27/12*** | (2006.01) |

(52) U.S. Cl.
CPC ..... *E02D 3/054* (2013.01); *E02D 3/08* (2013.01); *E02D 5/66* (2013.01); *E02D 7/18* (2013.01); *E02D 11/00* (2013.01); *E02D 27/12* (2013.01)

(58) Field of Classification Search
CPC ..... E02D 3/054; E02D 3/08; E02D 3/046; E02D 27/12
See application file for complete search history.

(56) References Cited

U.S. PATENT DOCUMENTS

| | | | | |
|---|---|---|---|---|
| 4,018,056 A * | 4/1977 | Poma | E02D 15/04 405/233 |
| 8,838,344 B2 * | 9/2014 | Callan | E02D 3/08 701/50 |
| 10,961,678 B2 * | 3/2021 | Degen | E02D 3/054 |
| 2015/0104260 A1 * | 4/2015 | Degen | E02D 3/046 405/232 |

* cited by examiner

*Primary Examiner* — Sean D Andrish
(74) *Attorney, Agent, or Firm* — Muirhead and Saturnelli, LLC

(57) ABSTRACT

A vibrator assembly comprising a feed pipe that has a longitudinal axis as well as a first end and a second end. The vibrator assembly may further comprise a vibrator unit that is mechanically coupled to the feed pipe, and a filling assembly which extends into the feed pipe at the first end and is designed to pick up material and direct same into the feed pipe. The feed pipe may have at least two separate channels from the first end to the second end and parallel to the longitudinal axis.

17 Claims, 19 Drawing Sheets

VIBRATOR ASSEMBLY FOR CREATING STONE COLUMNS, AND METHOD FOR CREATING STONE COLUMNS

TECHNICAL FIELD

The system described herein relates to a vibrator assembly for creating stone columns and to a method for operating such a vibrator assembly.

BACKGROUND OF THE INVENTION

Stone columns are columns of material which are introduced into the ground and are used in the building industry to improve the properties of the ground for subsequent building development. In order to create stone columns, use can be made of vibrator assemblies, which with the aid of vibrations penetrate to some extent into the ground and generate a drill hole in the ground. Thereafter, the vibrator assembly is used to direct material, for example dry concrete, recycled concrete, rubble, sand, gravel or a mixture thereof, into the drill hole and the material is then compacted. By virtue of this operation being repeated a number of times, the stone column of material is filled up, bit by bit, to the surface of the ground. The amount of time required for creating stone columns is determined to a decisive extent by the amount of time required for charging the vibrator assembly and for the stone-column-filling operation.

Known vibrator assemblies have the disadvantage that only a limited quantity of material can be directed into the drill hole per unit of time.

SUMMARY OF THE INVENTION

Described herein is an improved vibrator assembly which allows more material to be directed into the drill hole per unit of time.

In some embodiments of the system described herein, a vibrator assembly has a silo pipe with a longitudinal axis and with a first end and a second end. In addition, the vibrator assembly may have a vibrator unit, which is coupled mechanically to the silo pipe, and an introduction arrangement, which opens out into the silo pipe at the first end. The introduction arrangement may be designed to accommodate material and direct it into the silo pipe, wherein the silo pipe may have at least two separate channels running from the first end to the second end and parallel to the longitudinal axis.

In a further example of a vibrator assembly, the vibrator assembly has a silo pipe with a longitudinal axis and with a first end and a second end. Furthermore, the vibrator assembly may have a vibrator unit, which is coupled mechanically to the silo pipe, and an introduction arrangement, which opens out into the silo pipe at the first end and is designed to accommodate material and direct it into the silo pipe. The vibrator assembly may also have a supply unit, which is designed to deliver material into the introduction arrangement of the vibrator assembly, wherein the supply unit is arranged on the silo pipe or on the introduction arrangement at least such that it can move parallel to the longitudinal axis of the silo pipe.

In some embodiments, a method for operating a vibrator assembly has the following steps: placing the silo pipe on an underlying surface, creating a drill hole by movement of the silo pipe cyclically up and down at least on the underlying surface or in the drill hole, and supplying the silo pipe, by way of the supply unit, with material for filling the drill hole, wherein the movements of the supply unit along the silo pipe are controlled independently of the movements of the silo pipe.

BRIEF DESCRIPTION OF THE DRAWINGS

The system described herein will be explained in more detail hereinbelow with reference to the examples illustrated in the figures. The illustrations are not necessarily true to scale and the invention is not restricted just to the aspects and examples illustrated. Rather, what is important here is to illustrate the principles on which the system described herein is based. In the figures.

In the figures, identical reference signs denote identical or similar components with an identical or similar meaning and/or function.

DESCRIPTION OF VARIOUS EMBODIMENTS

Figure 1A:
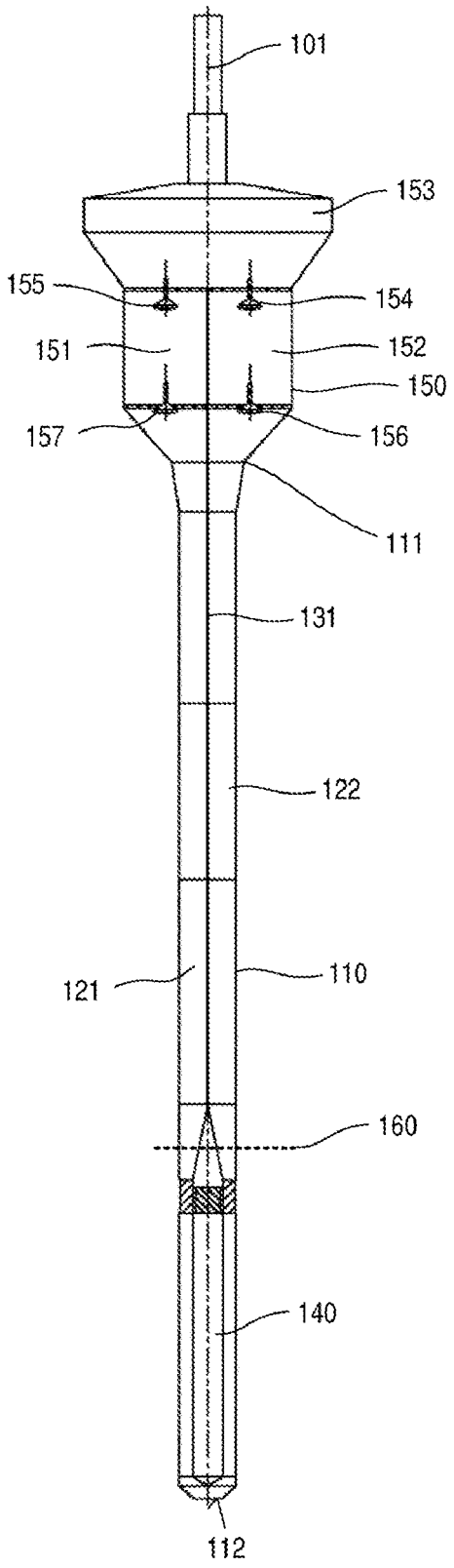
FIGS. 1A and 1B show cut-away illustrations of an illustrative vibrator assembly, according to an embodiment of the system described herein.
Figure 1B:
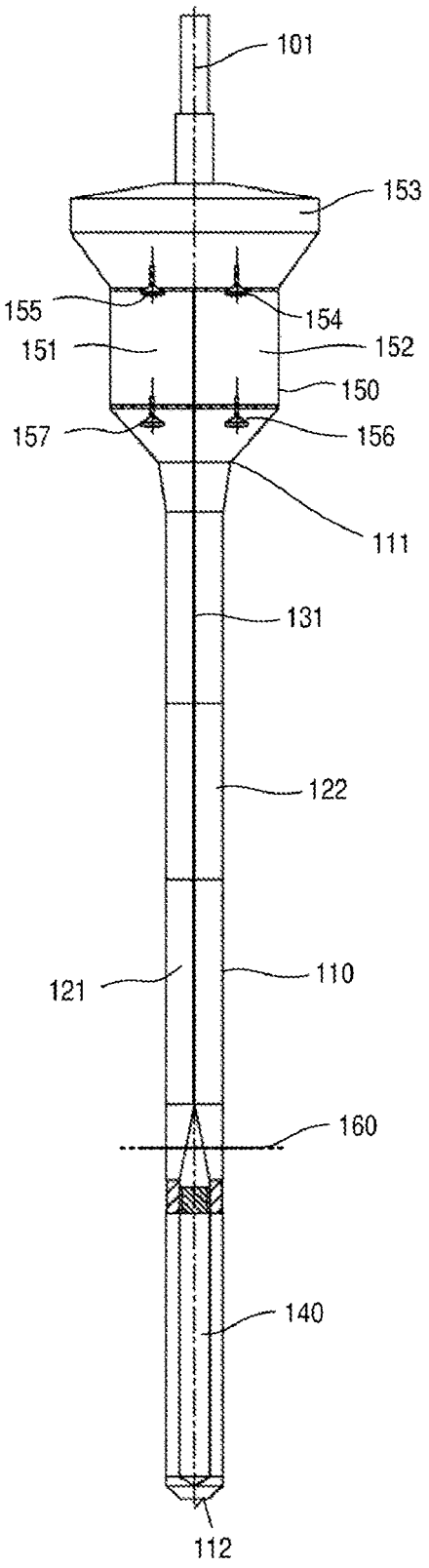

FIGS. 1A and 1B show two cut-away illustrations of an illustrative vibrator assembly. The vibrator assembly may have a silo pipe 110 with a longitudinal axis 101 and with a first end 111 and a second end 112. The silo pipe 110 and an introduction arrangement 150 may be rotationally symmetrical in relation to the longitudinal axis 101. The silo pipe 110 is that part of the vibrator assembly which is designed to penetrate at least to some extent into the ground when the vibrator assembly is in operation. The introduction arrangement 150 may be arranged at the first end 111 of the silo pipe 110, and it opens out into the first end 111 of the silo pipe 110 and may be designed to accommodate material and direct it into the silo pipe 110. The introduction arrangement 150 and the silo pipe 110 may be of different cross-sectional shapes and cross-sectional sizes in a respective cross-sectional plane. The cross-sectional planes may run perpendicularly to the longitudinal axis 101 of the silo pipe 110. The material may be, for example, rubble, sand, gravel or a mixture thereof.

The silo pipe 110 may be divided into at least two channels 121 and 122 from the first end 111 to the second end 112 and parallel to the, and/or along the, longitudinal axis 101 of the silo pipe 110. Two such channels are illustrated in FIGS. 1A and 1B. The channels 121 and 122 may be separated from one another, for example, by a crosspiece 131. The channels 121 and 122 may also be separated from one another in a gas-tight manner and may have at least more or less identical surface areas in a cross-sectional plane which is arranged perpendicularly to the longitudinal axis 101 of the silo pipe 110.

The introduction arrangement 150, which opens out into the first end 111 of the silo pipe 110, may have one or more chambers. In the example illustrated, the introduction arrangement 150 has two chambers 151 and 152. The number of chambers may be selected in dependence on the number of channels in the silo pipe 110. In the example illustrated, the chambers 151 and 152 are separated from one another in a gas-tight manner. In each case, one chamber 151 or 152 of the introduction arrangement 150 may be connected to, in each case, one channel 121 or 122 of the silo pipe 110. Material may be directed into the channels 121 and 122 of the silo pipe 110 via the chambers 151 and 152 of the introduction arrangement 150. The chambers 151 and 152 may be designed to accommodate a predefined quantity of material and discharge it into the channels 121 and 122 of the silo pipe 110. The chambers 151 and 152 may have one or more hoppers 153, which facilitate filling of the chambers 151 and 152.

In the example of FIGS. 1A and 1B, each of the chambers 151 and 152 of the introduction arrangement 150 may be opened or closed by, in each case, one first valve 154 and 155 and by, in each case, one second valve 156 and 157. In each case, the first valves 154 and 155 form a gas-tight airlock with, in each case, the second valves 156 and 157. They may close the silo pipe 110 and the chambers 151 and 152 in a gas-tight manner in relation to the exterior surroundings. Alternately opening and closing the first valves 154 and 155 and the second valves 156 and 157, as is already known from airlocks for controlling pressure, makes it possible for the introduction arrangement 150 to be filled with material and, at the same time, to prevent gas from flowing in an uncontrolled manner out of the silo pipe 110 or into the silo pipe 110. The gas may be, for example, compressed air or a pressurized gas mixture.

The vibrator assembly may have a vibrator unit 140, which may be arranged at the second end 112, and optionally also to some extent in the interior, of the silo pipe 110 and/or may be coupled mechanically thereto. The vibrator unit 140 may generate mechanical vibrations which propagate predominantly in the transverse direction of the silo pipe 110. During operation, the vibrator assembly may penetrate into the ground with the vibrator unit 140 in front. The channels 121 and 122 of the silo pipe 110 may be arranged around the vibrator unit 140 in an axial formation in relation to the longitudinal axis 101. In FIG. 1A, the valves 154 and 155 are open and material may flow out of the hopper 153 into the chambers 151 and 152. The valves 156 and 157 are closed. In FIG. 1B, the valves 156 and 157 are open and material may flow out of the chambers 151 and 152 into the silo pipe 110, in particular into the channels 121 and 122. The valves 154 and 155 are closed. The channels 121 and 122 may be designed such that they adapt to, or fit against, an outer contour of the vibrator unit 140 in as space-saving a manner as possible.

Figure 2:
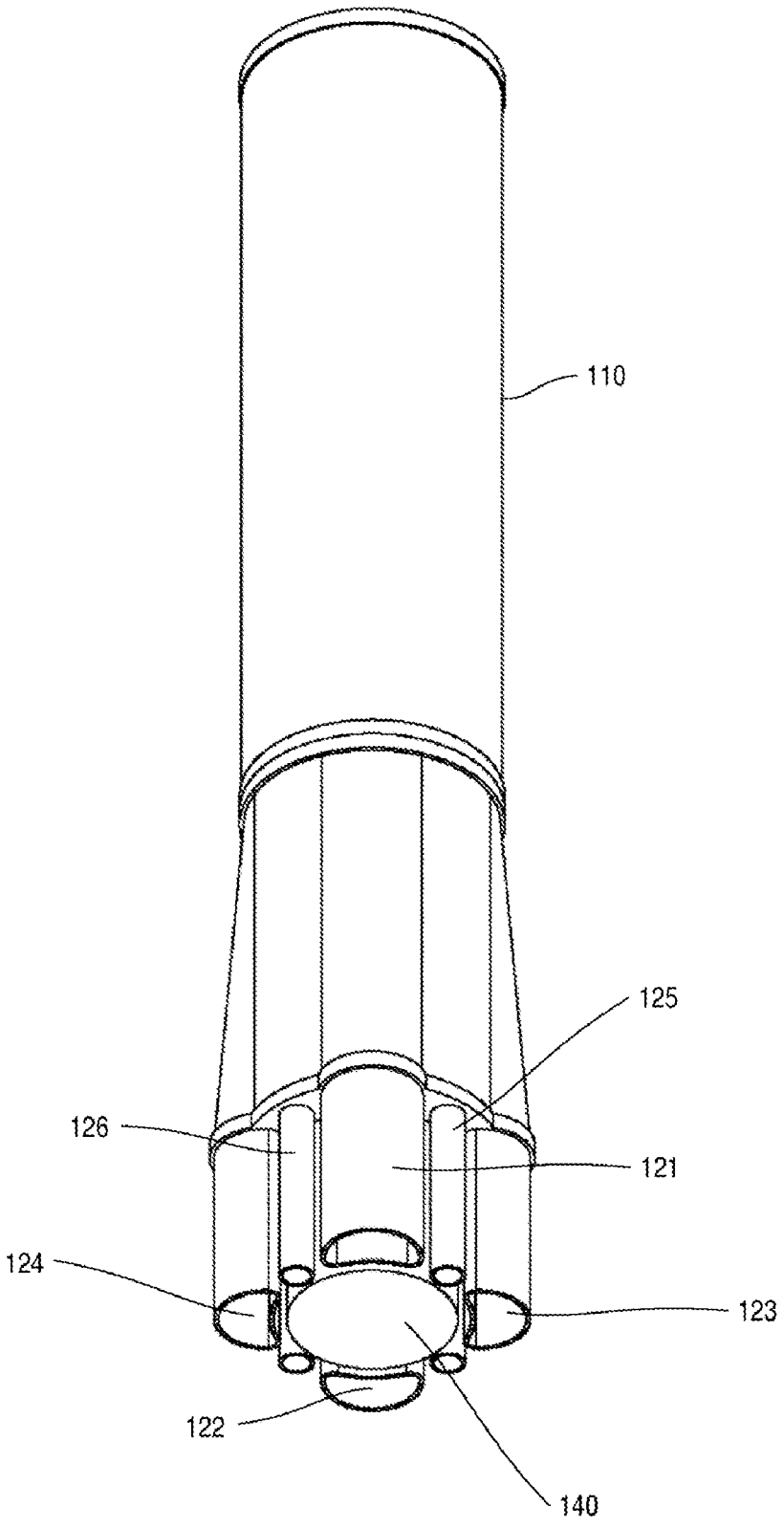
FIG. 2 shows a perspective view of an illustrative vibrator assembly with four channels, according to an embodiment of the system described herein.
Figure 3:
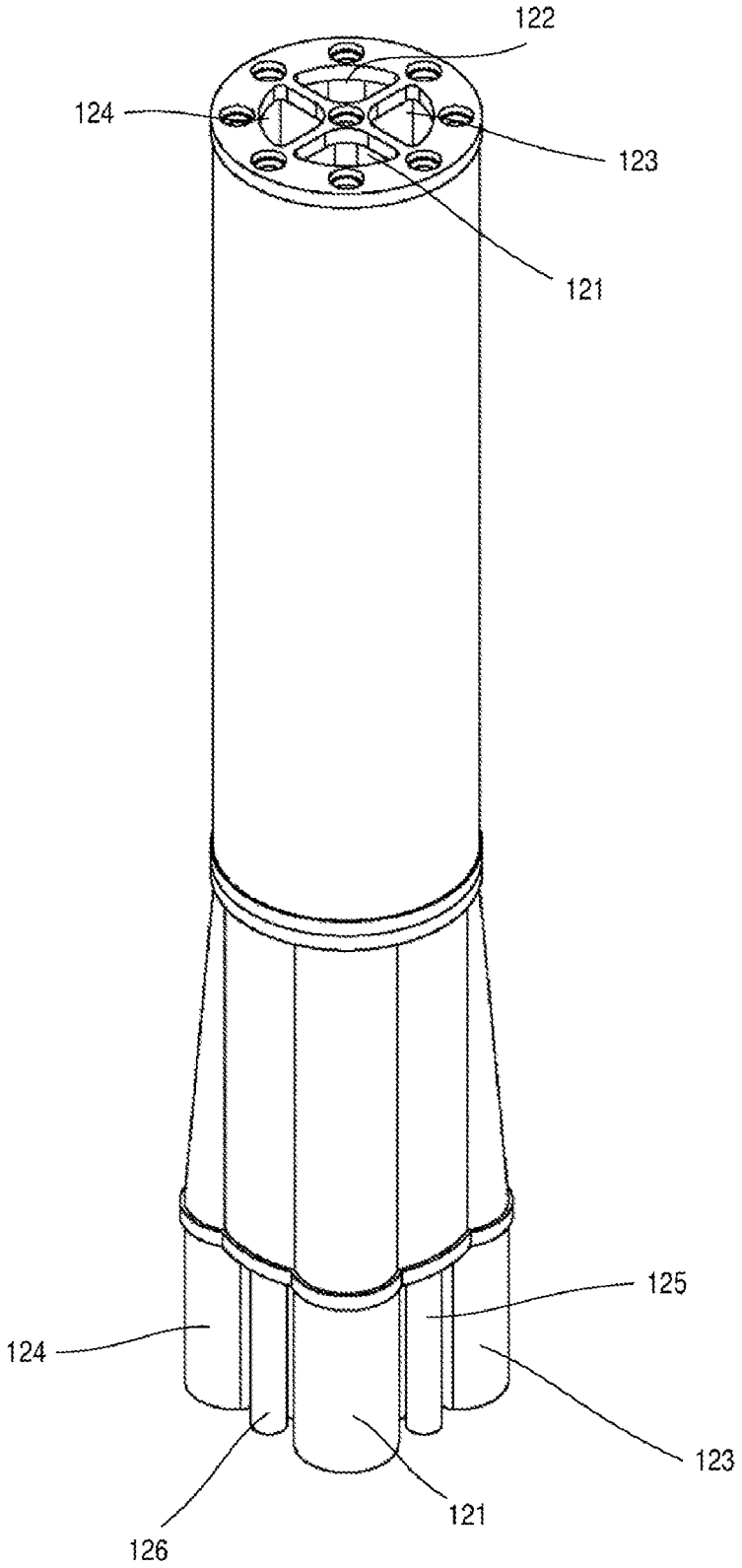
FIG. 3 shows a perspective view of the illustrative vibrator assembly in FIG. 2, according to an embodiment of the system described herein.

FIGS. 2 and 3 show perspective views of a further example of the silo pipe 110. The silo pipe 110 may have one or more channels 121, 122, 123 and 124 (four channels are illustrated in the figures) and may have one or more supply channels, which run parallel to the longitudinal axis 101 and to some extent in the interior of the silo pipe 110. In the example illustrated, the silo pipe 110 has four supply channels. Two of four supply channels 125 and 126 may be seen in FIG. 3. Within the silo pipe 110, the supply channels 125 and 126 may be separated from the channels 121, 122, 123 and 124 of the silo pipe 110 in a gas-tight manner and, for example, via a crosspiece 131 or a tube. Lines, for example compressed-air lines, electric lines, hydraulic lines, data lines or water lines, may be arranged in the interior of the supply channels 125 and 126. For example, the vibrator unit 140 may be supplied with electric voltage via an electric line leading from the first end 111 of the silo pipe 110 to the vibrator unit 140 through the supply channels. In one example of the vibrator assembly, water may be directed to the second end 112 of the silo pipe 110 through the supply channels 125 and 126 or through a water line located in the supply channels 125 and 126. It is also possible for the vibrator assembly to have separate compressors, for generating compressed air, for each channel 121, 122, 123 and 124 of the silo pipe 110. The supply channels may be arranged, and distributed uniformly, around the vibrator unit 140.

The supply channels 125 and 126, or the lines in the supply channels 125 and 126, may open out into at least one of the channels 121, 122, 123 and 124 of the silo pipe 110 in the region of the vibrator unit 140. As an alternative to this, it is also possible for the supply channels 125 and 126, or the lines in the supply channels 125 and 126, to open out into at least one of the channels 121, 122, 123 and 124 of the silo pipe 110 in the region of the first end 111 of the silo pipe 110. It is also possible for at least part of the supply channels 125 and 126, or of the lines in the supply channels 125 and 126, to be guided out of the silo pipe 110 at the second end 112 of the same. Furthermore, the supply channels 125 and 126, or the lines in the supply channels 125 and 126, may open out into the channels 121, 122, 123 and 124 of the silo pipe 110 at a number of locations.

Figure 4A:
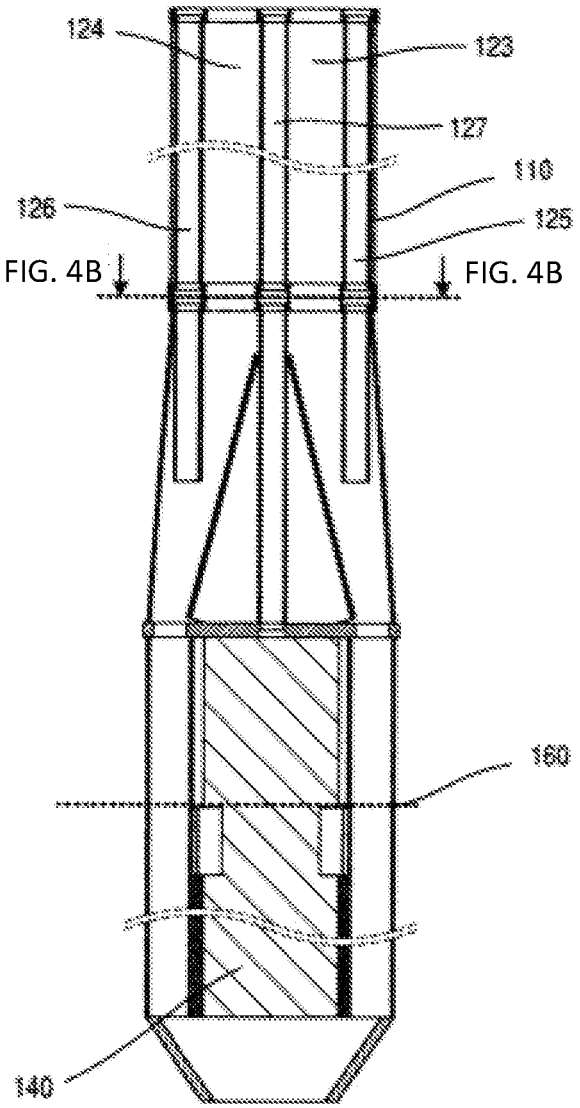
FIG. 4A shows a cut-away view of the illustrative vibrator assembly in FIGS. 2 and 3, according to an embodiment of the system described herein.
Figure 4B:
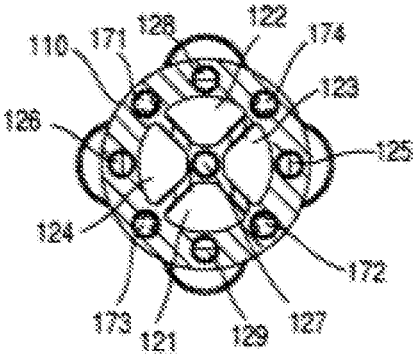
FIG. 4B shows a sectional view of the cut-away view of the illustrative vibrator assembly in FIG. 4A according to an embodiment of the system described herein.

FIG. 4A illustrates a cut-away view of the silo pipe 110, and FIG. 4B illustrates a sectional view of the cut-away view of FIG. 4A. It can be gathered from FIGS. 4A and 4B that the silo pipe 110 may have four channels 121, 122, 123 and 124. The channels 121, 122, 123 and 124 of the silo pipe 110 may be guided around the vibrator unit 140 and enclose the vibrator unit 140. The supply channels 125 and 126 may likewise be arranged around the vibrator unit 140. The vibrator unit 140 may be supplied with electric current via a supply channel 127. Compressed air may be directed into the channel 121 in the region of a plane 160 via the supply channel 125. Moreover, compressed air may be directed into the channel 121 in the region of a plane 161, which may be arranged perpendicularly to the longitudinal axis 101 of the silo pipe 110. The silo pipe 110 according to FIGS. 4A and 4B may have a circular cross section in a plane which is oriented perpendicularly to the longitudinal axis 101. The circular arrangement makes it possible for a plurality of supply channels to be accommodated in the silo pipe 110. In the example illustrated, these are the supply channels 125, 126, 127, 128, 129, 171, 172, 173 and 174. For example, water may be directed into the drill hole via the supply channels 125, 126, 127, 128, 129, 171, 172, 173 and 174.

Figure 5A:
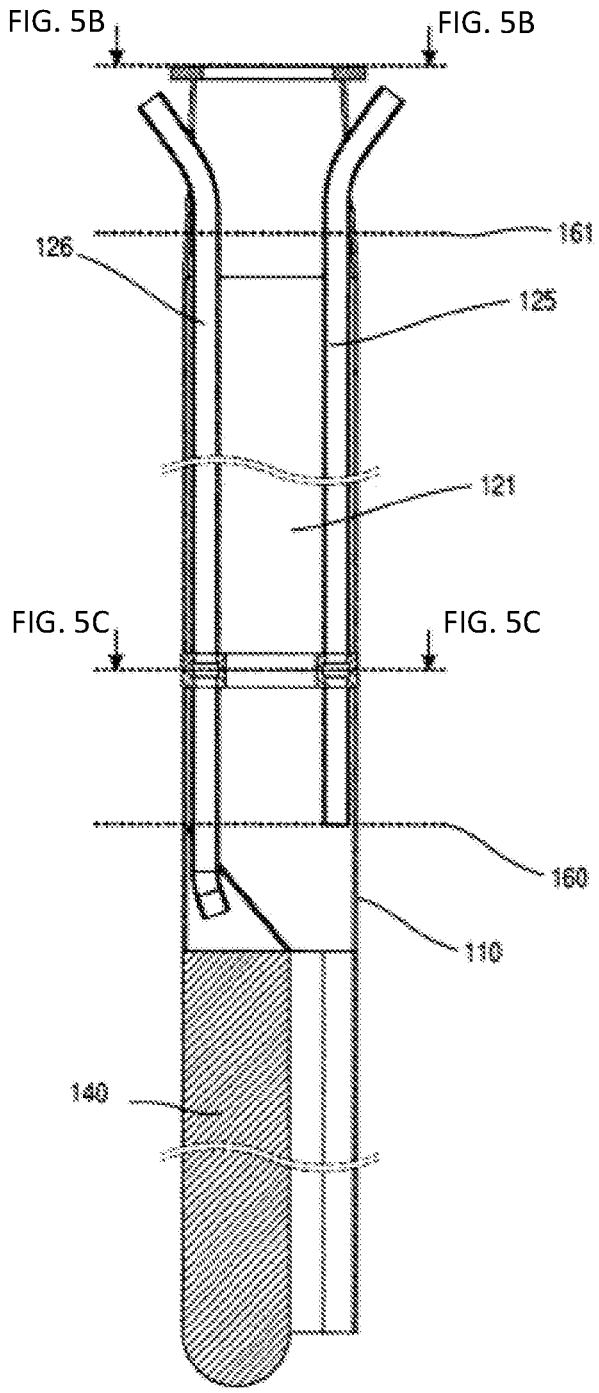
FIG. 5A shows a cut-away view of an illustrative vibrator assembly with one channel, according to an embodiment of the system described herein.
Figure 5B:
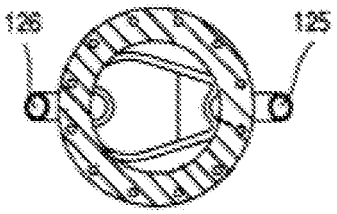
FIGS. 5B and 5C show sectional views of the cut-away view of an illustrative vibrator assembly with one channel of FIG. 5A, according to an embodiment of the system described herein.
Figure 5C:
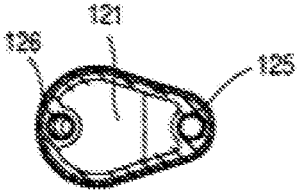

FIG. 5A shows a cut-away view of an illustrative silo pipe 110 with just one channel 121 and two supply channels 125 and 126; and FIGS. 5B and 5C show sectional views of the cut-way view of FIG. 5A. The vibrator unit 140 may be supplied with electric current via the supply channel 126. Compressed air may be directed into the channel 121 in the region of a plane 160 via the supply channel 125. Moreover, compressed air may be directed into the channel 121 in the region of a plane 161, which may be arranged perpendicularly to the longitudinal axis 101 of the silo pipe 110. It is possible to choose between a compressed-air infeed in the region of the plane 160 and a compressed-air infeed in the region of the plane 161, and to control said infeeds independently of one another.

Figure 6A:
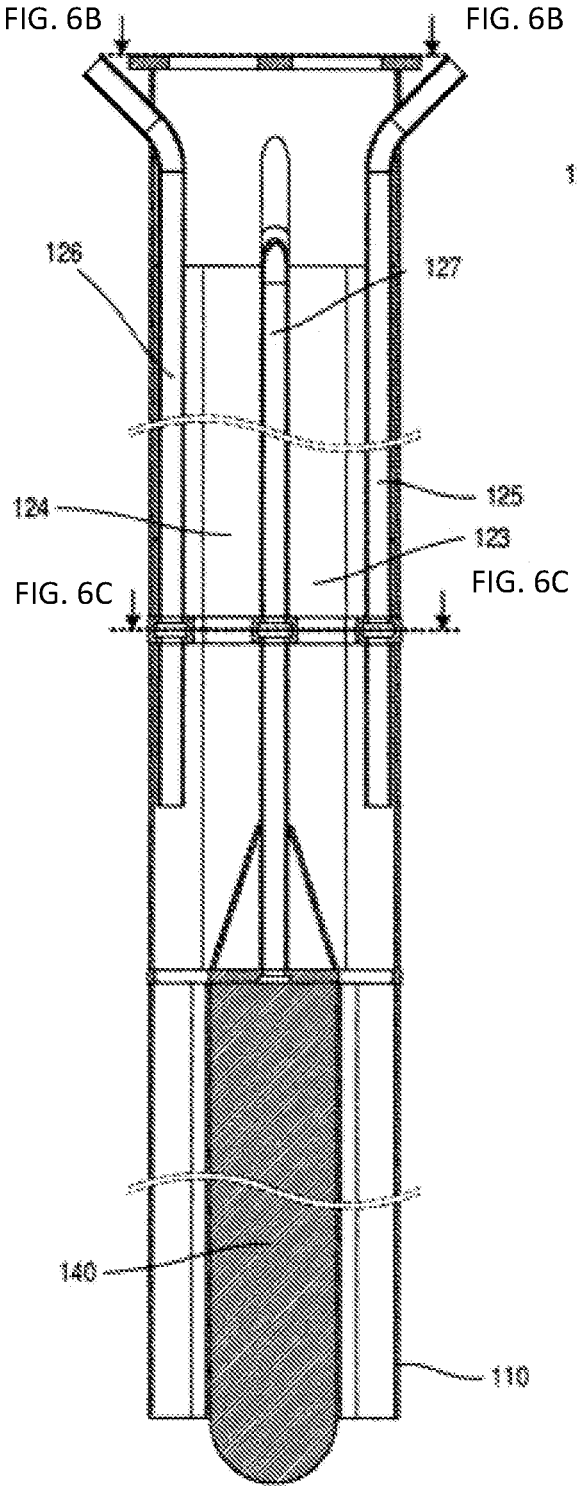
FIG. 6A shows a cut-away view of an illustrative vibrator assembly with two channels, according to an embodiment of the system described herein.
Figure 6B:
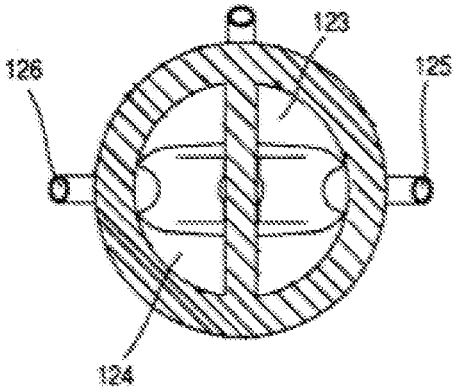
FIGS. 6B and 6C show sectional views of the cut-away view of an illustrative vibrator assembly with two channels of FIG. 6A, according to an embodiment of the system described herein.
Figure 6C:
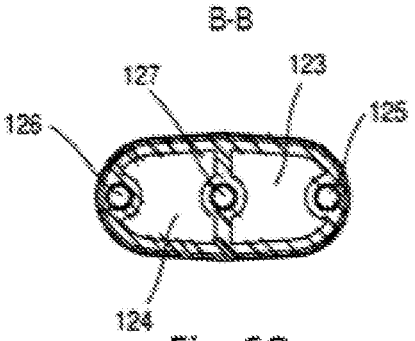

FIG. 6A shows a cut-away view of an illustrative silo pipe 110 with two channels 123 and 124 and two supply channels 125 and 126; and FIGS. 6A and 6B show sectional views of the cut-way view of FIG. 6A. The vibrator unit 140 may be supplied with electric current via the supply channel 127. Compressed air may be directed into, in each case, one of the channels 123 and 124 in the region of the plane 160 and/or in the plane 161 via the supply channels 125 and 126. The channels 123 and 124 may be separated from one another in a gas-tight manner and may be supplied with compressed air independently of one another by in each case one dedicated compressor. This may ensure that the two channels 123 and 124 may be supplied with the same pressure and the same volume flow of the compressed air. Blockage of an individual channel may thus be reliably prevented. The pressure and the volume flow of the compressed air may differ in the two channels 123 and 124. As an alternative to this, the compressed air may be fed to the two channels via a common compressor. In this case, use may be made of a valve that distributes the pressure and the volume flow of the compressed air, in particular uniformly, between the two channels. The intention is to prevent the situation where significantly more compressed air escapes through one of the two channels 123 or 124 than via the other channel 123 or 124.

The vibrator assembly described in conjunction with FIGS. 1-6 may be used for creating stone columns. For this purpose, the vibrator assembly may be suspended, with the introduction arrangement 150, on a crane or some other piece of lifting equipment (not illustrated). The vibrator assembly may then be moved by the crane to the desired position of the stone column. The vibrator unit 140 may be switched on and the second end 112 of the silo pipe 110 may be brought into contact with the ground. Under the action of the net weight of the vibrator assembly and of the vibrations generated by the vibrator unit 140, the silo pipe 110 of the vibrator assembly penetrates into the ground to a predefined depth and thus generates a drill hole (not illustrated). As the silo pipe 110 is penetrating into the ground, water may be blown out of the second end 112 of the silo pipe 110 so that the second end 112 of the silo pipe 110 is cooled and the drill hole is kept clear. The water may also flow off between the silo pipe 110 and the ground and from the second end 112 of the silo pipe 110 in the direction of the ground surface. The friction between the silo pipe 110 and the ground may be reduced as a result.

As soon as the silo pipe 110 has penetrated into the ground to the predefined depth, the crane may lift the vibrator assembly out of the drill hole by a predefined distance and direct material out of the channels 121 and 122 of the silo pipe 110 into the drill hole. The material may be delivered out of the channels 121 and 122 under the action of gas, in particular of compressed air. In one example, compressed air may be directed into the channels 121 and 122 in the region of the first end 111 of the silo pipe 110 via one or more upper compressed-air infeeds. The number of upper compressed-air infeeds may be selected in dependence on the number of channels 121 and 122 in the silo pipe 110. This creates, within the interior of the channels 121 and 122, a positive pressure, which results in the material in the channels 121 and 122 being pushed into the drill hole. At the same time, the feed of compressed air into the channels 121 and 122 prevents soil and sludge from penetrating into the channels 121 and 122. In addition, it is possible in the region of the plane 160, which may be located between the vibrator unit 140 and the first end of the silo pipe 110, for one or more lower compressed-air infeeds (not illustrated) to open out into the channels 121 and 122 of the silo pipe 110 and direct compressed air at least to some extent into the channels 121 and 122, or out of the second end 112 of the silo pipe 110 via the channels 121 and 122. The plane 160 may be arranged perpendicularly to the longitudinal axis 101. The number of lower compressed-air infeeds may be selected in dependence on the number of channels 121 and 122 in the silo pipe 110. The line or the supply channel 125 or 126, which directs compressed air into the channels 121 and 122 in the region of the second end 112 of the silo pipe 110, may also be referred to as an injection line.

As a result of an injection line being used, the material may be carried along out of the channels 121 and 122 by the air stream and it is possible to avoid or mitigate wedging of the pieces of material on account of dilatancy. Dilatancy is understood to mean an increase in the volume, and therefore an increase in the viscosity, of a granular material. Dilatancy occurs in the case of densely packed granular material which is subjected to the action of high shear forces. This is the case if the material is blown out of the channels 121 and 122 only via the upper compressed-air infeed. This subsequently may result in the channels 121 and 122 blocking in the region of the second end 112 of the silo pipe 110. The additional use of the injection line may ensure that the material is directed out of the channels 121 and 122, into the drill hole, without obstruction. It is possible to control the pressure and the volume flow which is directed into the channels 121 and 122 via the injection line. It is possible to regulate the pressure and the volume flow in the injection line (lower compressed-air infeed) in dependence on the nature of the material. In addition, it is also possible to regulate the pressure and the volume flow of the upper compressed-air infeed. Feeding compressed air via the upper compressed-air infeed and/or the lower compressed-air infeed may give rise to a material/air mixture in the silo pipe 110. The proportion of air in the material/air mixture may be increased by way of the lower compressed-air infeed. This subsequently may result in the material/air mixture being loosened, and therefore the viscosity of said mixture decreasing, and the material/air mixture being easier to direct out of the silo pipe 110.

Once the material has been directed into the drill hole, the vibrator assembly may be introduced into the drill hole again by a predefined distance and the directed-in material is thus packed laterally into the ground and compacted. The method steps described may be repeated until the stone column, of the desired diameter, has been completed.

Figure 7:
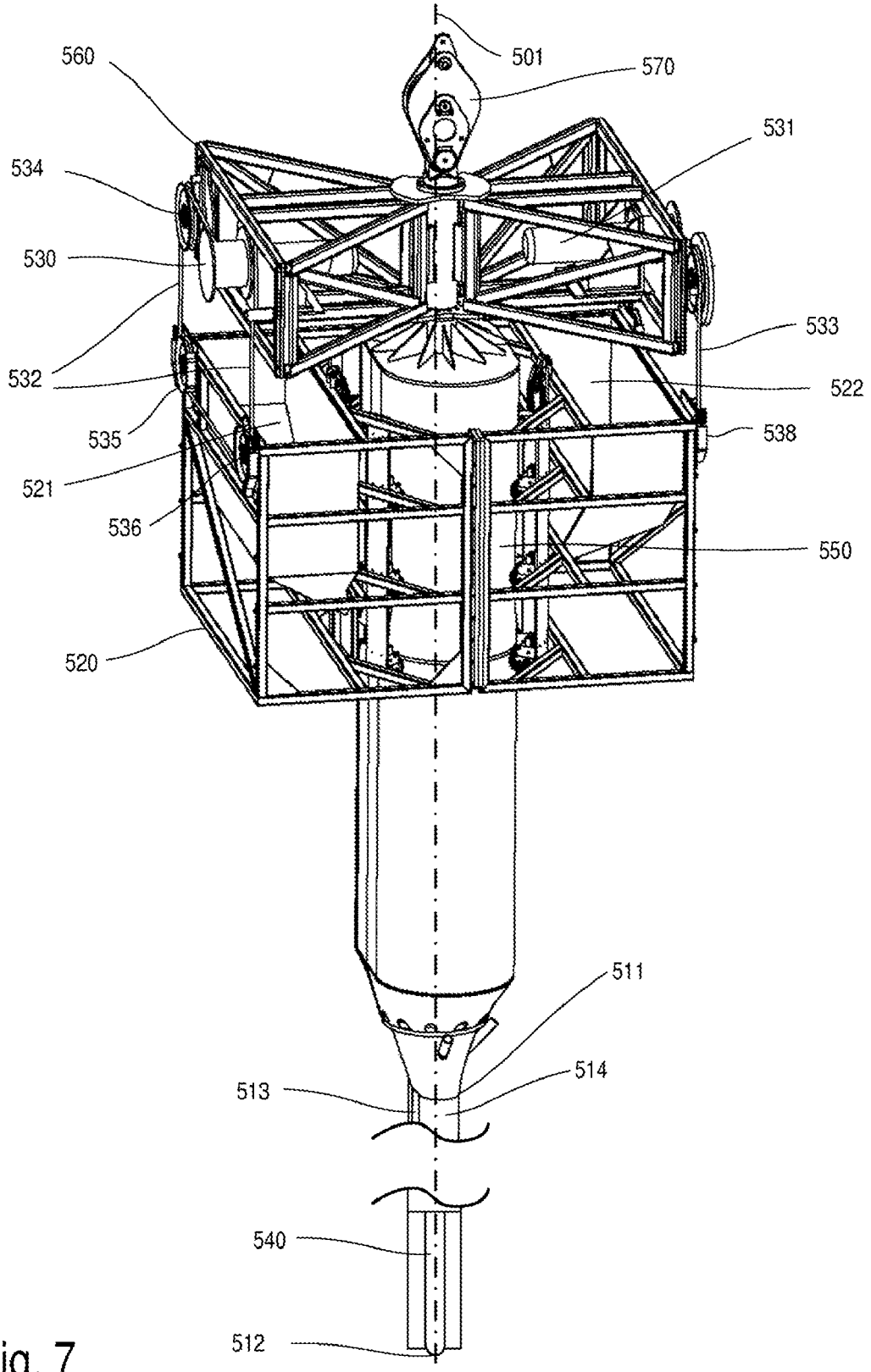
FIG. 7 shows a perspective view of an illustrative vibrator assembly, according to an embodiment of the system described herein.

FIG. 7 shows a perspective view of a further example of a vibrator assembly. This vibrator assembly comprises a silo pipe 510, an introduction arrangement 550 for charging the silo pipe 510 with material, and a supply unit 520 for feeding material into the introduction arrangement 550. The material may be, for example, rubble, sand, gravel or a mixture thereof. The silo pipe 510 has a longitudinal axis 501 and also a first end 511 and a second end 512. The silo pipe 510 and the introduction arrangement 550 of the vibrator assembly may be rotationally symmetrical in relation to the longitudinal axis 501. The introduction arrangement 550 may open out into the silo pipe 510 at the first end 511 and may accommodate material and direct it into the silo pipe 510. The supply unit 520 may deliver material to the introduction arrangement 550 of the silo pipe 510, and introduce the same. For this purpose, the supply unit 520 may be arranged on the silo pipe 510 or on the introduction arrangement 550 at least such that the supply unit 520 may move parallel to the longitudinal axis 501 of the silo pipe 510. The vibrator assembly may have a vibrator unit 540, which may be fitted in the region of the second end 512, and in the interior, of the silo pipe 510.

The silo pipe 510 may have at least two channels 513, 514, as has been explained with reference to FIGS. 1-6. However, this is just one example. The silo pipe 510 may also be designed such that it has just one or more channels.

The vibrator assembly may have a carrying frame 560, which is arranged on a side of the introduction arrangement 550 which is directed away from the first side of the silo pipe 510. The vibrator assembly may be suspended on a crane via the carrying frame 560. The carrying frame 560 may be designed in the form of a lattice-tube frame and have one or more winches 530 and 531. The winches 530 and 531 may be fastened on the carrying frame 560 so as to be fixed in terms of their position and orientation in relation to the carrying frame 560, and they may have cables 532 and 533, which have one end fastened on the respective winch 530 and 531 and have a further end fastened on the supply unit 520.

In the example of FIG. 7, the vibrator assembly has two winches 530 and 531 with the cables 532 and 533. The cables 532 and 533 may be guided in each case over a deflecting roller 534 (a further deflecting roller, which is fastened on the carrying frame 560 for the winch 531, is not illustrated), which is fastened on the carrying frame 560. Furthermore, the cables 532 and 533 may be guided over further deflecting rollers 535, 536, 538 and 539, which are fastened on the supply unit 520. The carrying frame 560 and the supply unit 520 may have a respective cross section in a direction perpendicular to the longitudinal axis 501 of the silo pipe 510. The cross sections of the carrying frame 560 and of the supply unit 520 may be rectangular. In order for the supply unit 520 to be guided on the silo pipe 510, and on the introduction arrangement 530, in as stable a manner as possible, in particular so as to be stable in terms of rotation in relation to the longitudinal axis 501, the deflecting rollers 534, 535, 536, 538, 539 and the further deflecting roller may be arranged on the carrying frame 560 and on the supply unit 520 as far away as possible from the longitudinal axis 501 of the silo pipe.

The cables 532 and 533 may be wound up by or unwound from the winches 530 and 531. On the precondition that the silo pipe 510 stands more or less perpendicularly to the ground, the supply unit 520 may move away from the carrying frame 560 along the longitudinal axis 501 of the silo pipe 510 when the cables 532 and 533 are being unwound from the winches 530 and 531. The situation is reversed for the winding-up operation. As an alternative to the winch concept described, it is also possible for the vibrator assembly to have three or more winches. In one example, the vibrator assembly may have four winches, this making it possible to ensure tilting of the supply unit 520 even without deflecting rollers being used. The four cables of the four winches may be mechanically connected directly to the supply unit 520 at the locations at which the deflecting rollers 535, 536, 538 and 539 were mounted in the previous example.

In one example of the vibrator assembly, the silo pipe 510 of the vibrator assembly may be replaced by the silo pipe 110, which was described in conjunction with FIGS. 1-6. The vibrator assembly may be suspended on a crane or an excavator via a deflecting roller 570. The deflecting roller 570 may also be referred to as a roller head.

Figure 8:
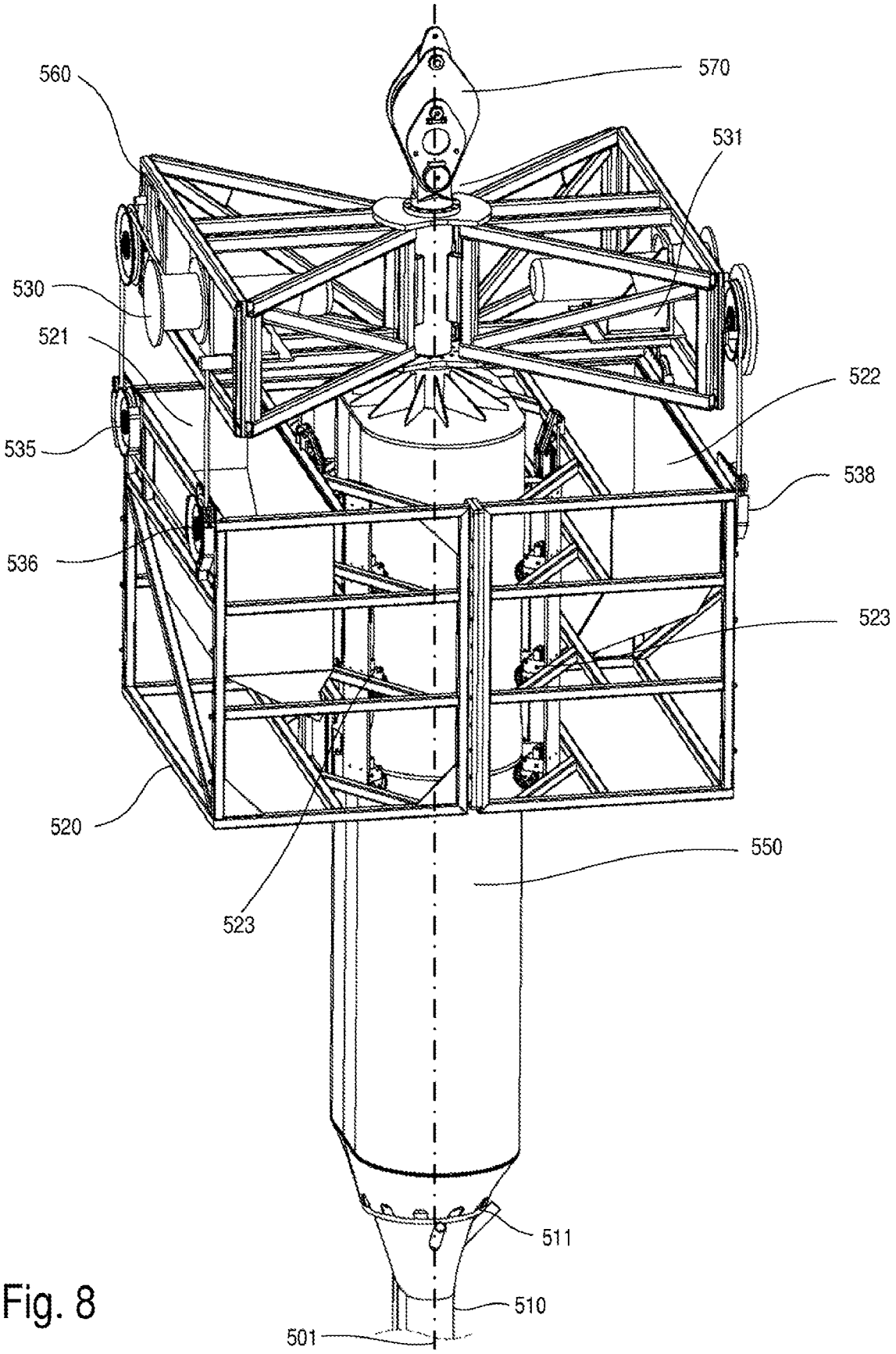
FIG. 8 shows a perspective detail-specific view of an upper part of an illustrative vibrator assembly, according to an embodiment of the system described herein.

FIG. 8 illustrates a perspective view of an vibrator assembly, according to some embodiments of the system described herein. It can be gathered from FIG. 8 that the supply unit 520 may be a lattice-tube frame, in which one or more material containers 521 or 522 are arranged. The supply unit 520 may surround the introduction arrangement 550 of the vibrator assembly and may be arranged on the same. The supply unit 520 may have guide elements 523, which butt against an outer side of the introduction arrangement 550 and guide the supply unit 520 on the introduction arrangement 550. The introduction arrangement 550 and the silo pipe 510 may have different cross-sectional surface areas, and may be of different cross-sectional shapes, in a direction perpendicular to the longitudinal axis 501 of the silo pipe 510. For example, the silo pipe 510 may have a circular cross section and the introduction arrangement 550 may be elliptical.

The guide elements 523 may be designed such that they can adapt to the different cross sections and can guide the supply unit 520 both on the introduction arrangement 550 and on the silo pipe 510. For example, the guide elements 523 may be rollers or skids which are pressed against the introduction arrangement 550 or the silo pipe 510 in a direction perpendicular to the longitudinal axis 501 of the silo pipe 510 by way of a spring. In one example of the vibrator assembly, the guide elements 523 may also be designed such that the supply unit 520 cannot rotate about the longitudinal axis 501 of the silo pipe 510. For example, the guide elements 523 may have a rail system. It is also possible for both the silo pipe 510 and the supply unit 520 to be arranged, and guided, on a leader rig (not illustrated).

Figure 9:
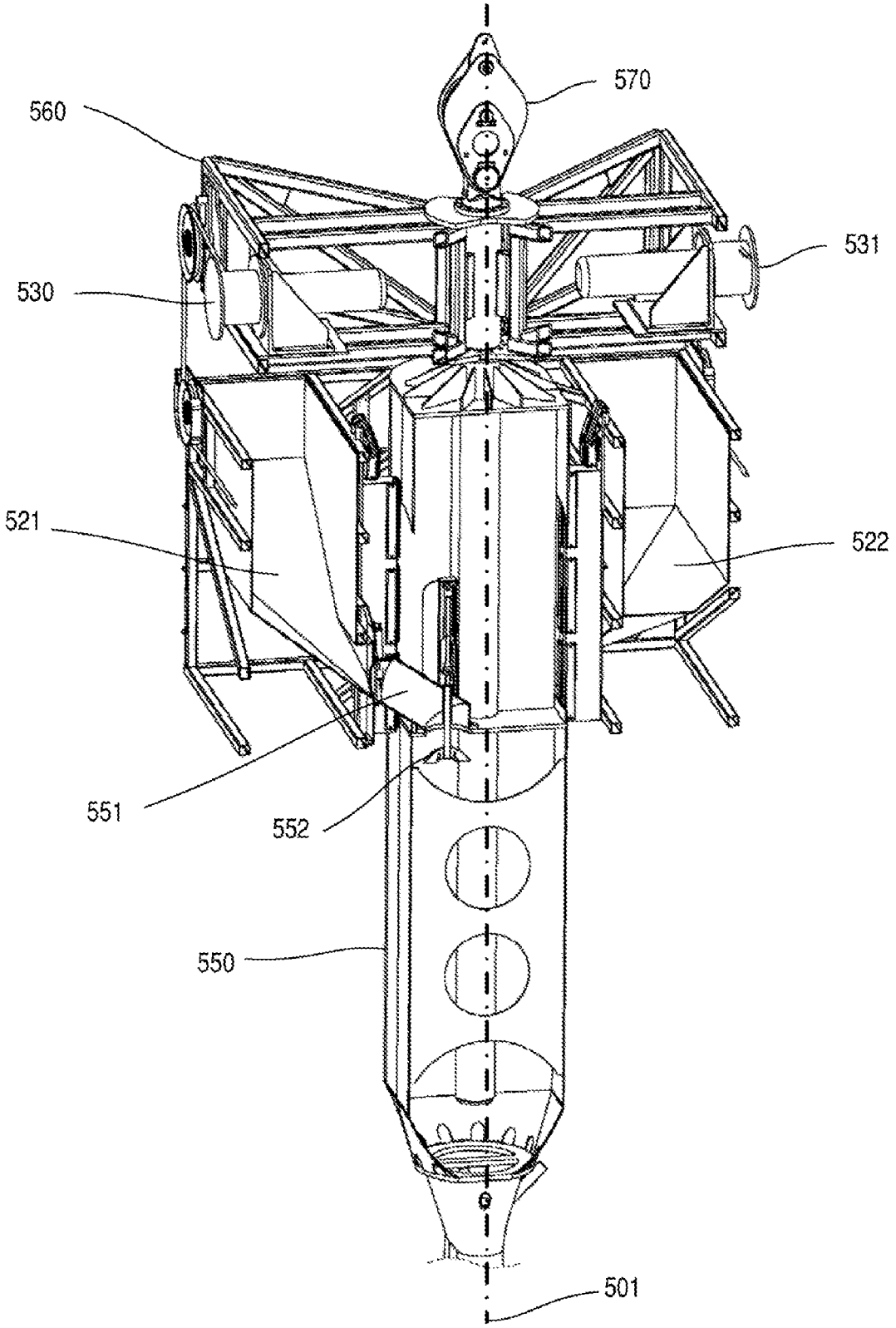
FIG. 9 shows a cut-away illustration of an illustrative vibrator assembly, according to an embodiment of the system described herein.
Figure 10:
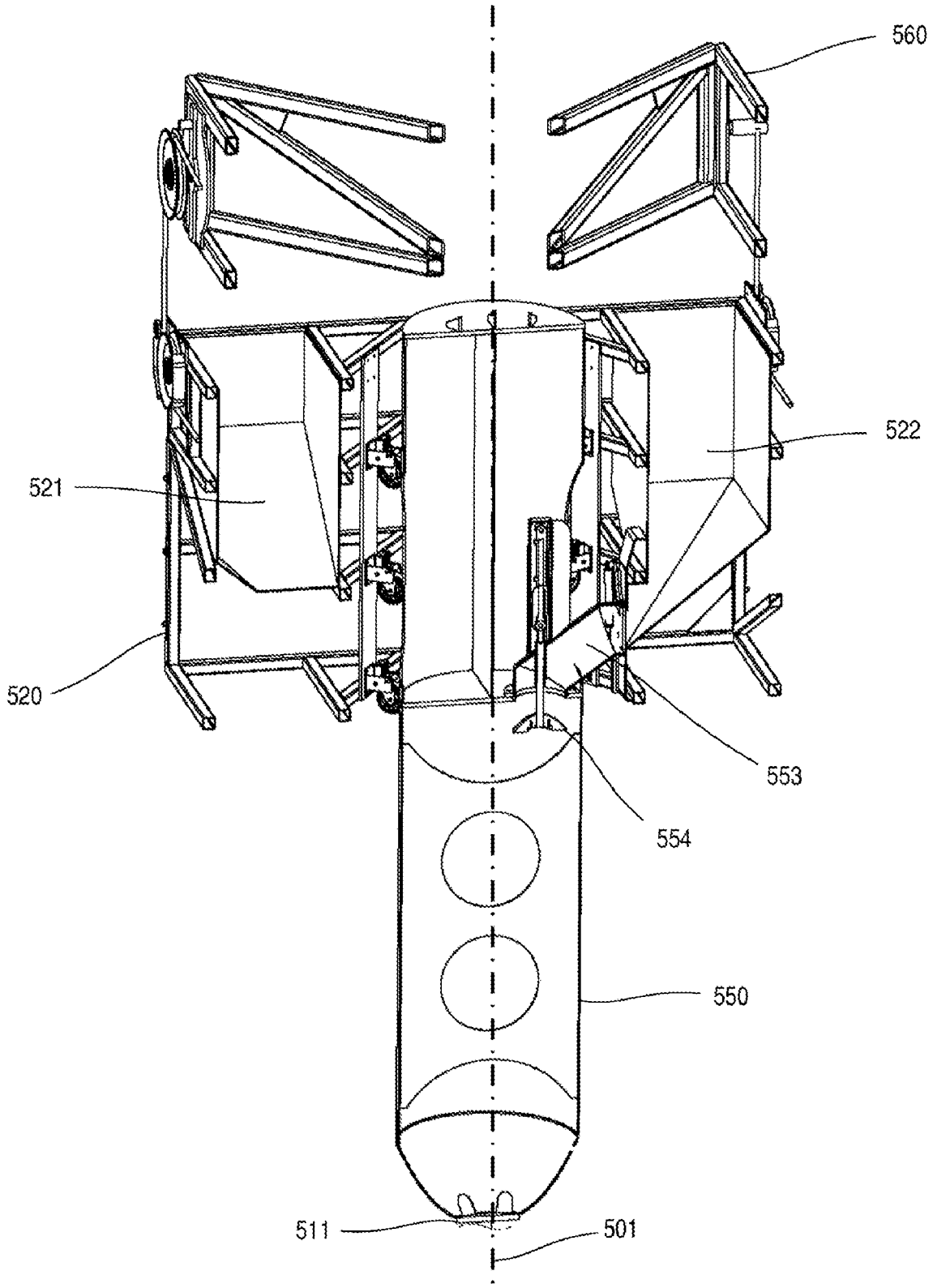
FIG. 10 shows a further cut-away illustration of the illustrative vibrator assembly in FIG. 9, according to an embodiment of the system described herein.

FIGS. 9 and 10 illustrate a cut-away view of the supply unit 520. When the vibrator assembly is in operation, the longitudinal axis 501 may be located parallel to a direction of action of gravitational force and/or thus more or less perpendicularly to the ground surface. The two material containers 521 and 522 may be arranged on opposite sides of the silo pipe 510, as seen in relation to the longitudinal axis 501 of the silo pipe 510. It is also possible, as a result of the configuration of the two material containers 521 and 522, for the material supplied thereto to have its weight distributed likewise more or less equally to the left and right of the longitudinal axis 501. This symmetrical arrangement, as seen in relation to the weight, allows the weight of the supply unit 520 to be balanced such that, when the vibrator assembly is in operation, the center of gravity of the supply unit 520 is located along the longitudinal axis 501 of the silo pipe 510 and also moves along said longitudinal axis 501, both in the filled state and in the empty state of the material containers 521 and 522. The supply unit 520 thus may not transmit any bending moment to the silo pipe 510, or to the introduction arrangement 550, which would result in an at least undesirable, but often also inadmissible, deviation from the vertical state during the creation of the column of material. The construction method may also ensure that the orientation of the longitudinal axis 501 in relation to the ground surface also does not alter independently of a loading state of the material containers 521 and 522. The material containers 521 and 522 may also be replaced by a material container designed in the form of an integral component (not illustrated). What has been said in relation to the material containers 521 and 522 applies equally to the material container in the form of an integral component, which may also be referred to as a feed hopper.

It can further be gathered from FIGS. 9 and 10 that the material containers 521 and 522 taper in the direction of the silo pipe 510 and may open out into the introduction arrangement 550. The introduction arrangement 550 contains a piece of tube 551 and 553 for each material container 521 and 522, said piece of tube directing the material from the material container 521 and 522 at least into the introduction arrangement 550 or into the silo pipe 510. In each case, one material valve 552 or 554, which releases or blocks the inflow of material into the silo pipe 510, may be arranged on those sides of the pieces of tube 551 and 553 which are directed toward the silo pipe 510. The material in the material containers 521 and 522 may be emptied into the introduction arrangement 550 via closures, which open out into the pieces of tube 551 and 553. The closures may be, for example, flap closures, conical closures or slide closures. The closures may be both active and passive components.

Figure 11:
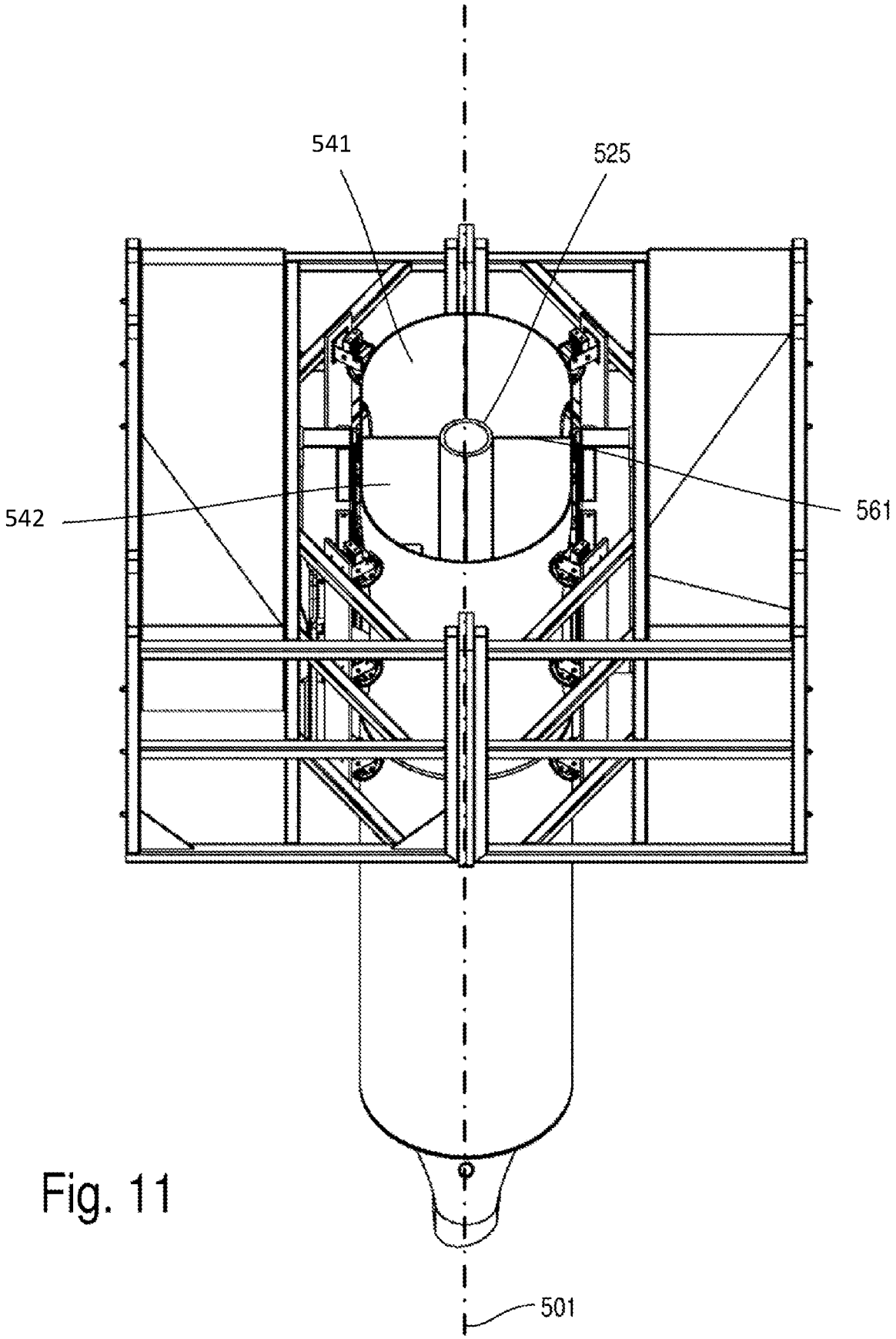
FIG. 11 shows a perspective view of an illustrative supply unit, according to an embodiment of the system described herein.
Figure 12:
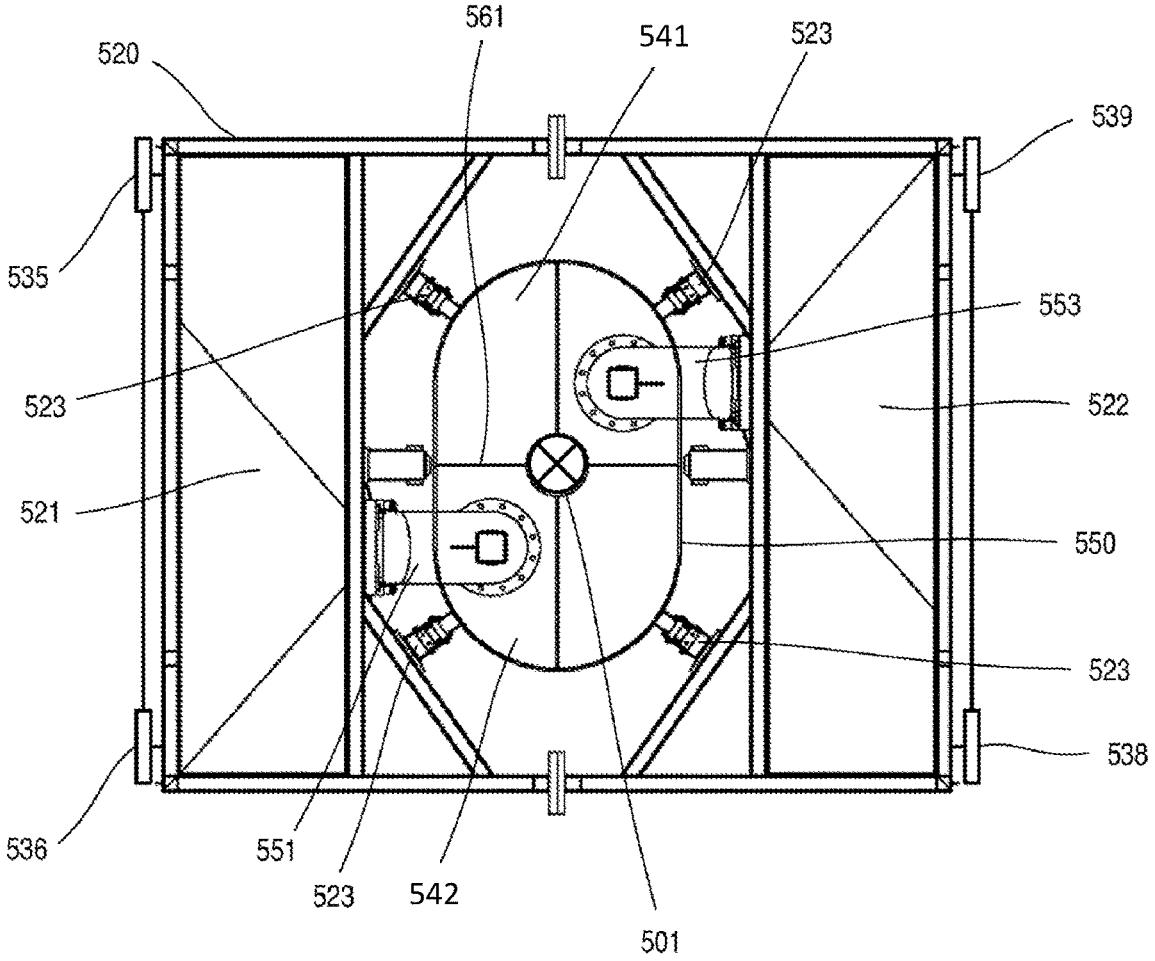
FIG. 12 shows a plan view of an illustrative vibrator assembly with a supply unit, according to an embodiment of the system described herein.

FIGS. 11 and 12 show a perspective view and a plan view of an illustrative vibrator assembly. In the example illustrated, the silo pipe 510 has two channels 541 and 542, which extend along the longitudinal axis 501 of the silo pipe 510 and are separated from one another by a crosspiece 561. A supply channel 525, which may accommodate for example compressed-air lines, water lines, hydraulic lines or electric lines, may be arranged in the crosspiece 561 and between the two channels 541 and 542. The supply channel 525 may also itself be a water line for directing water to the second end 512 of the silo pipe 510.

It can be seen in the illustrative vibrator assembly in FIG. 12 that the two pieces of tube 551 and 553 are offset in relation to one another in the silo pipe 510. As a result of this arrangement, the pieces of tube 551 and 553 may project further into the interior of the silo pipe 510 and it is thus easier for the silo pipe 510 to be filled with material from the material containers 521 and 522.

When the vibrator assembly is in operation, the silo pipe 510 of the vibrator assembly may have penetrated at least to some extent into the ground. During the subsequent creation of a stone column, material is directed, via the silo pipe 510, into a drill hole (not illustrated) formed by the silo pipe 510. For this purpose, the supply unit 520 is lowered by the winches 530 and 531, along the silo pipe 510, to the surface of the ground. While the supply unit 520 is standing on the ground, the cables 532 and 533 are kept taut by the winches 530 and 531 by way of a small amount of prestressing.

As long as the supply unit 520 is located on the ground, or in the vicinity of the ground, the material containers 521 and 522 may be filled with material, for example, by a wheel loader. In the case of one example of the vibrator assembly, the feed hopper 610 may be configured such that it may be loaded fully, and without restriction, only from one side of the material container. The same also applies to an illustrative supply unit 520 with two or more material containers 521 and 522. In these cases, the material containers 521 and 522 may be configured, and coupled mechanically to one another, such that all the material containers 521 and 522 of the supply unit 520 may be loaded from one side of the supply unit 520. For example, it is possible for the material containers 521 and 522, for this purpose, to be of hopper-like configuration and to be connected to one another via a channel which directs material from one material container 521 into the other 522.

Once the material containers 521 and 522 have been loaded, they may be drawn by the winches 530 and 531, along the silo pipe 510, in the direction of the first end 511 of the silo pipe 510 as far as the introduction arrangement 550. The winches 530 and 531 may draw the supply unit 520 to the introduction arrangement 550 precisely to the extent where the material containers 521 and 522 may be emptied into the introduction arrangement 550 via the closures. The material then may be directed at least to some extent into the introduction arrangement 550, or into the silo pipe 510, via the valves 552 and 554. Once the material has been directed out of the material containers 521 and 522 at least to some extent into the introduction arrangement 550, or into the silo pipe 510, the supply unit 520 may be moved in the direction of the ground again by the winches 530 and 531. At ground level, the material containers 521 and 522 may be refilled and moved to the introduction arrangement 550 of the vibrator assembly. As a result of the winches 530 and 531, which are mounted on the vibrator assembly, it is possible for the vibrator assembly, irrespective of the amount of filling in the material containers 521 and 522, to penetrate further into the ground, fill the drill hole or compact the material in the drill hole. This operation may be repeated until the stone-column-filling operation is finished.

In one example of the vibrator assembly, the silo pipe 510 may be driven in, and the winches 530 and 531 and also the material valves 552 and 554 may be controlled, by an at least partially automated control means (not illustrated). Furthermore, it is possible for the processes of filling the drill hole and of charging the silo pipe 510 with material to be able to proceed simultaneously, for example, without any coordination work on the part of the crane operator. It is thus possible to deliver greater quantities of material into the silo pipe 510 per unit of time than would be possible without such a control means.

As an alternative to the winches 530 and 531, it is also possible for the supply unit 520 to be moved along the silo pipe 510 by a further winch. This alternative may also be referred to as a ride-on system for the supply unit 520. For rotationally secure fitting and/or for cable guidance when use is made of the further winch, the vibrator assembly may be fastened on the crane via a double roller head and controlled electronically. The electronic control means may be designed, for example, so that a movement of the silo pipe 510 into the drill hole, or out of the same, is compensated for by the further winch. A crane driver may control the vibrator assembly in full via simple commands. Manual, and separate, control of the vibrator, crane and supply unit can be dispensed with.

For example, the supply unit 520 may be activated via the further winch such that the supply unit 520 moves relative to the silo pipe 510 only in a predefined manner, if at all. The movements of the silo pipe 510 may be synchronized with the movements of the supply unit 520. In the case of this alternative, the weight of the supply unit 520 is absorbed by the further winch. In the case of this alternative, it is possible for only a very small bending moment, if any at all, to be transmitted to at least the silo pipe 510, or the introduction arrangement 550, by the supply unit 520. The center of gravity of the supply unit 520 may therefore also be located outside the longitudinal axis 501 and may move outside the longitudinal axis 501 without the silo pipe 510 or introduction arrangement 550 being subjected to a significant bending moment in the process.

Figure 13:
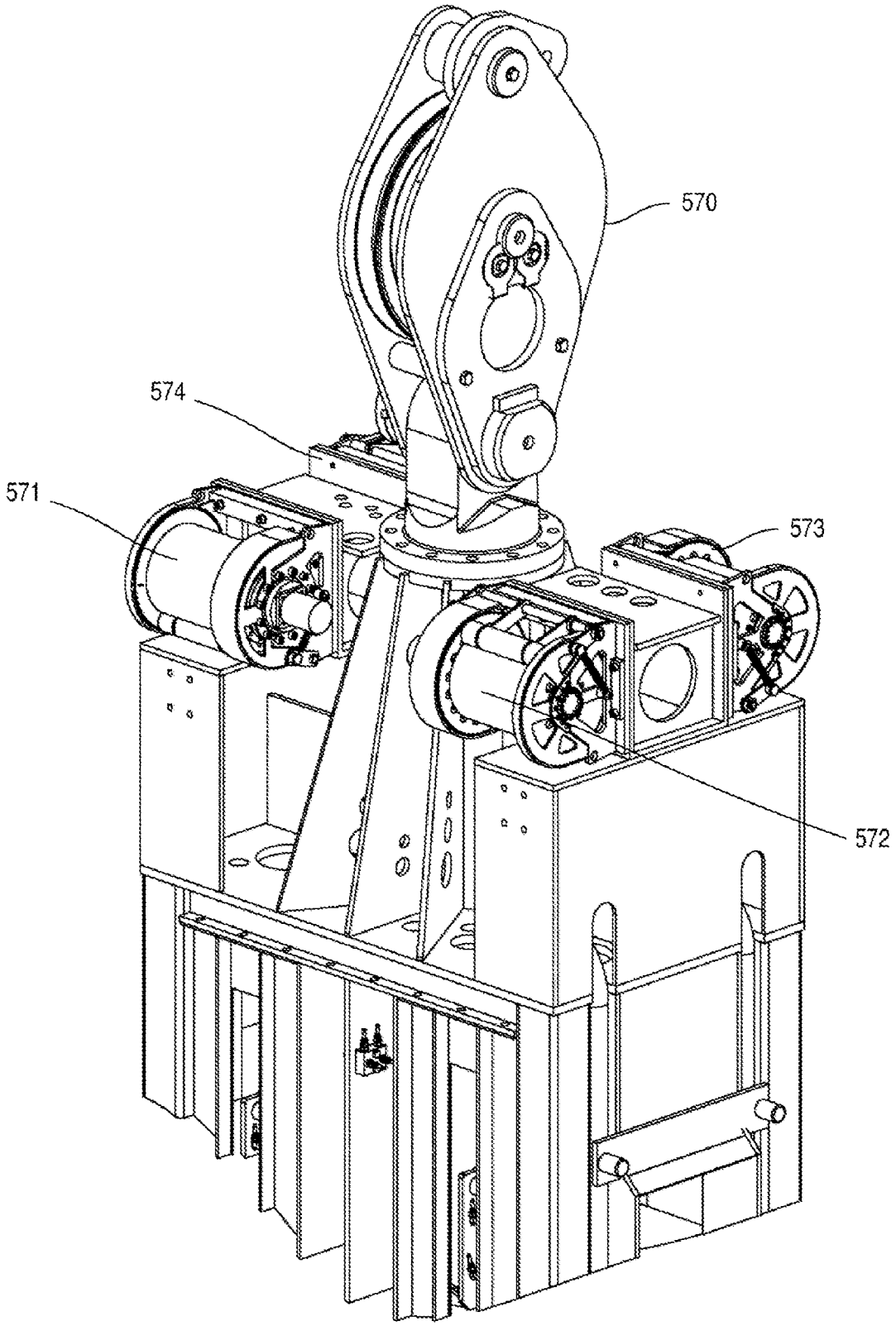
FIG. 13 shows an upper part of a further illustrative vibrator assembly, according to an embodiment of the system described herein.

FIG. 13 shows an upper side of an illustrative vibrator assembly, having the deflecting roller 570 and four winches 571, 572, 573 and 574. The vibrator assembly may be suspended on a crane or an excavator via the deflection roller 570. The vibrator assemblies illustrated in FIGS. 7 to 12 have in each case two winches 530 and 531, by way of which for example the supply unit 520 is moved along the silo pipe. In contrast to this, the illustrative vibrator assembly in FIG. 13 has two further winches in addition. The winches 571, 572, 573 and 574 illustrated are used to displace the supply unit 520. The cables of the winches 571, 572, 573 and 574 may be fastened at the four outermost corners of the supply unit 520, in order to minimize the rotation of the supply unit about the longitudinal axis (not shown in FIG. 13). A synchronous winding-up or unwinding operation of the winches 571, 572, 573 and 574 moves the supply unit 520 along the silo pipe.

Figure 14:
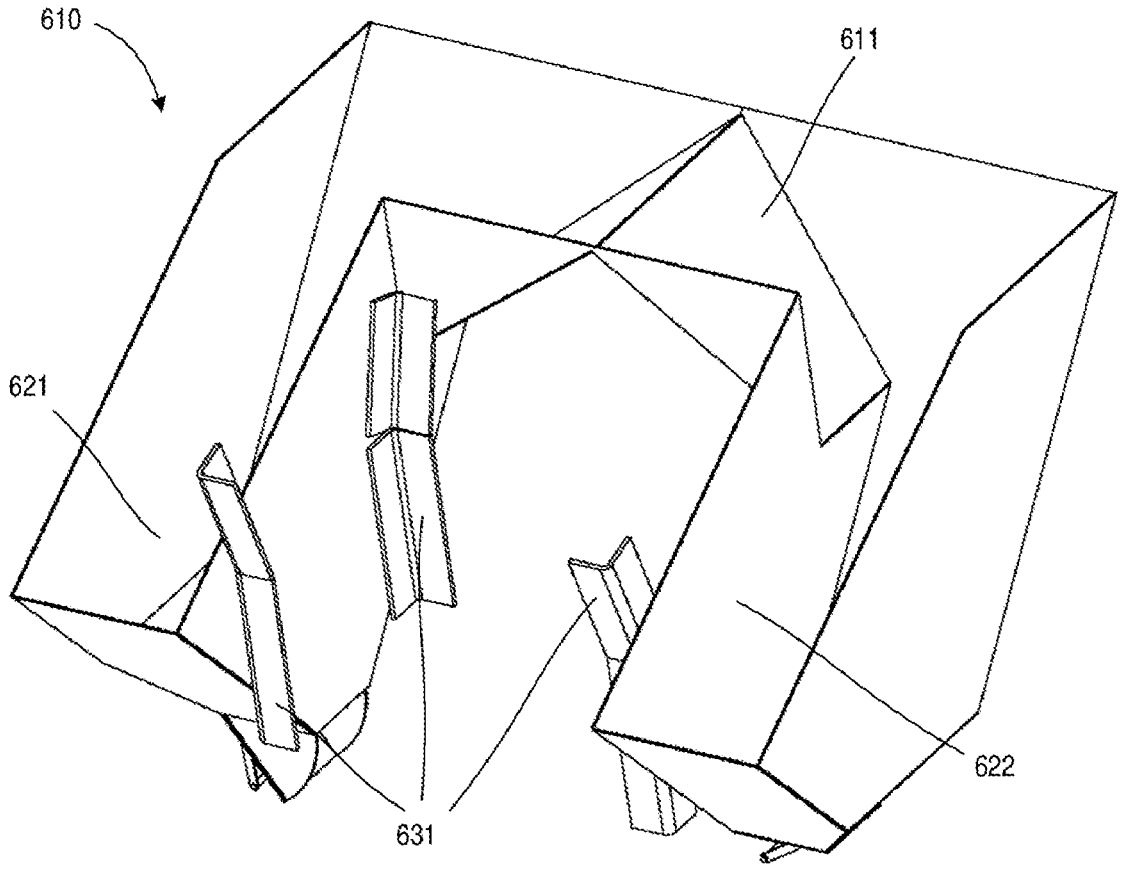
FIG. 14 shows a perspective view of an illustrative feed hopper, according to an embodiment of the system described herein.

FIG. 14 shows a perspective view of an illustrative feed hopper 610. The feed hopper 610 may have one or more material cavities 621 and 622 and also one or more guide rails 631. The feed hopper 610 may be guided at least on the silo pipe 510, or on the introduction arrangement 550, by the guide rails.

It is possible for the two material cavities 621 and 622 to be arranged parallel to one another, and at a predefined distance from one another, and to be surface-symmetrical in relation to one another, as seen in relation to a predefined plane. Each of the material cavities 621 and 622 may have a first side surface, wherein the two first side surfaces run truly parallel to one another and also parallel to the predefined plane. The two material cavities 621 and 622 may be connected mechanically via a run-off plate 611 to form a U-shaped, in particular horseshoe-shaped, feed hopper 610. For this purpose, the run-off plate 611 connects the two first ends of the material cavities 621 and 622. A U-shaped feed hopper 610 can be understood to mean that, in the installed state and as it is moving at least along the silo pipe 510 or the introduction arrangement 550, said feed hopper engages at least around the silo pipe 510 or the introduction arrangement 550 in a U-shaped manner. For example, the U-shaped feed hopper 610 may enclose the silo pipe 510 or the introduction arrangement 550 over an angle of 160° to 300°, an angle of 160° to 200° or an angle of approximately 180°. The same also applies to a horseshoe-shaped feed hopper.

The run-off plate 611 may be designed in the form of a two-sided ramp. In each case one side of the two-sided ramp slopes down in the direction of in each case one of the material cavities 621 and 622, and therefore, during the introduction operation, material in the region of the run-off plate 611 may be distributed between the two material cavities 621 and 622. The highest point of the two-sided ramp may be located in the predefined plane and may thus be arranged, at the same time, parallel to the two side surfaces.

Furthermore, the feed hopper 610 may be accommodated in the supply unit 520 or be attached directly by the winches 530 and 531. The feed hopper 610 may be attached, and moved, via the winches 530 and 531 in the same manner as has already been described in conjunction with the supply unit 520. For example, the feed hopper 610 may be suspended at at least four of its outer corners via deflecting rollers and moved along the vibrator assembly by the winches 530 and 531. The material cavities 621 and 622 may be arranged such that, in the state in which the feed hopper 610 is mounted on the vibrator assembly, they are arranged on opposite sides at least of the silo pipe 510 or of the introduction arrangement 550.

The run-off plate 611 may serve to facilitate filling of the feed hopper 610. The run-off plate 611 may be configured such that uniform filling of the feed hopper 610 is facilitated and, during introduction into the feed hopper 610, the material is distributed uniformly between the two material cavities 621 and 622. Furthermore, the geometrical shape of the material cavities 621 and 622 may be such that the material settles largely such that its center of gravity is located more or less along the axis 501.

Figure 15:
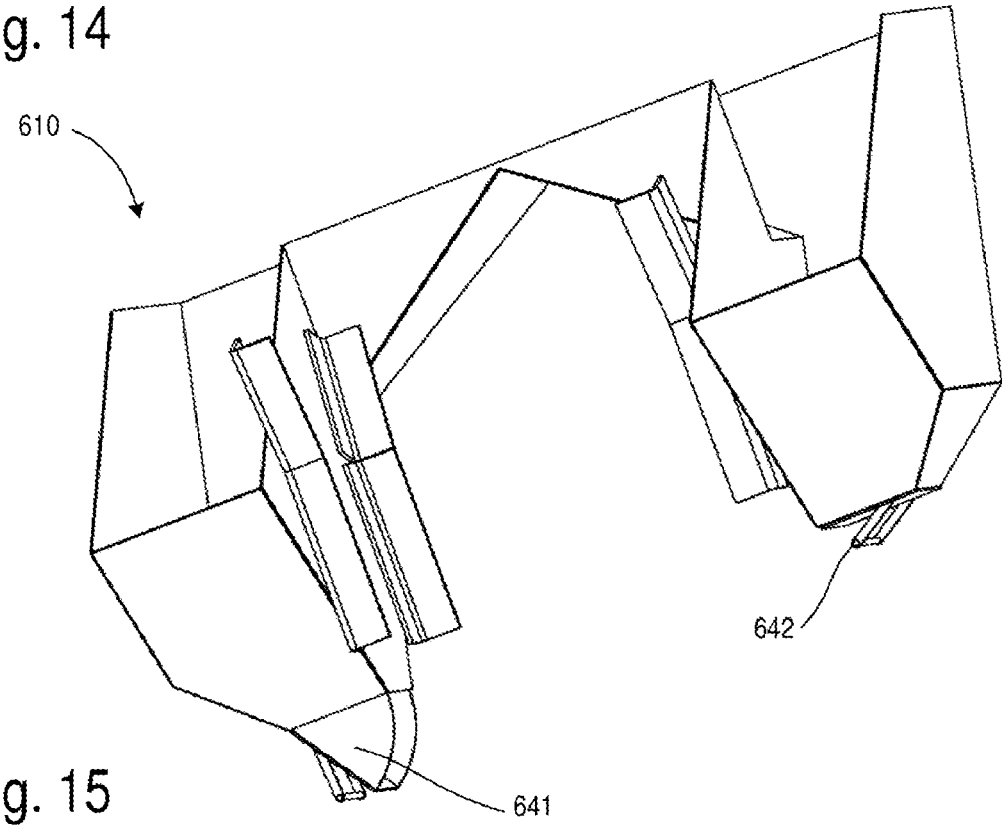
FIG. 15 shows a further perspective view of the illustrative feed hopper in FIG. 14, according to an embodiment of the system described herein.

FIG. 15 shows a further perspective view of the feed hopper 610. Each of the material cavities 621 and 622 may have one or more closures 641 and 642. In the example illustrated, the two closures 641 and 642 are flap closures, the closure 641 being illustrated in the open state. Furthermore, it is also possible to provide other types of closure, for example conical closures or slide closures. The closures may be active or passive components and may also be referred to as valves.

In one example, the closures 641 and 642 may be spring-loaded closures, in particular flap valves. These may be designed such that, in the closed state, they are already prestressed in their opening direction. For this purpose, use may be made of springs which are subjected to stressing when the closures 641 and 642 are being closed. Once the feed hopper 610 has reached a predefined position in the region of the introduction arrangement 550, the closures 641 and 642 may be unlocked via a suitable unlocking mechanism. Under the action of force of the springs, the closures 641 and 642 open automatically and the material may flow out of the feed hopper 610 and into the introduction arrangement 550. If the feed hopper 610 once again leaves its predefined position in the region of the introduction arrangement 550, the closures 641 and 642 may be closed again automatically, and under spring stressing, by a suitable mechanical device.

Figure 16:
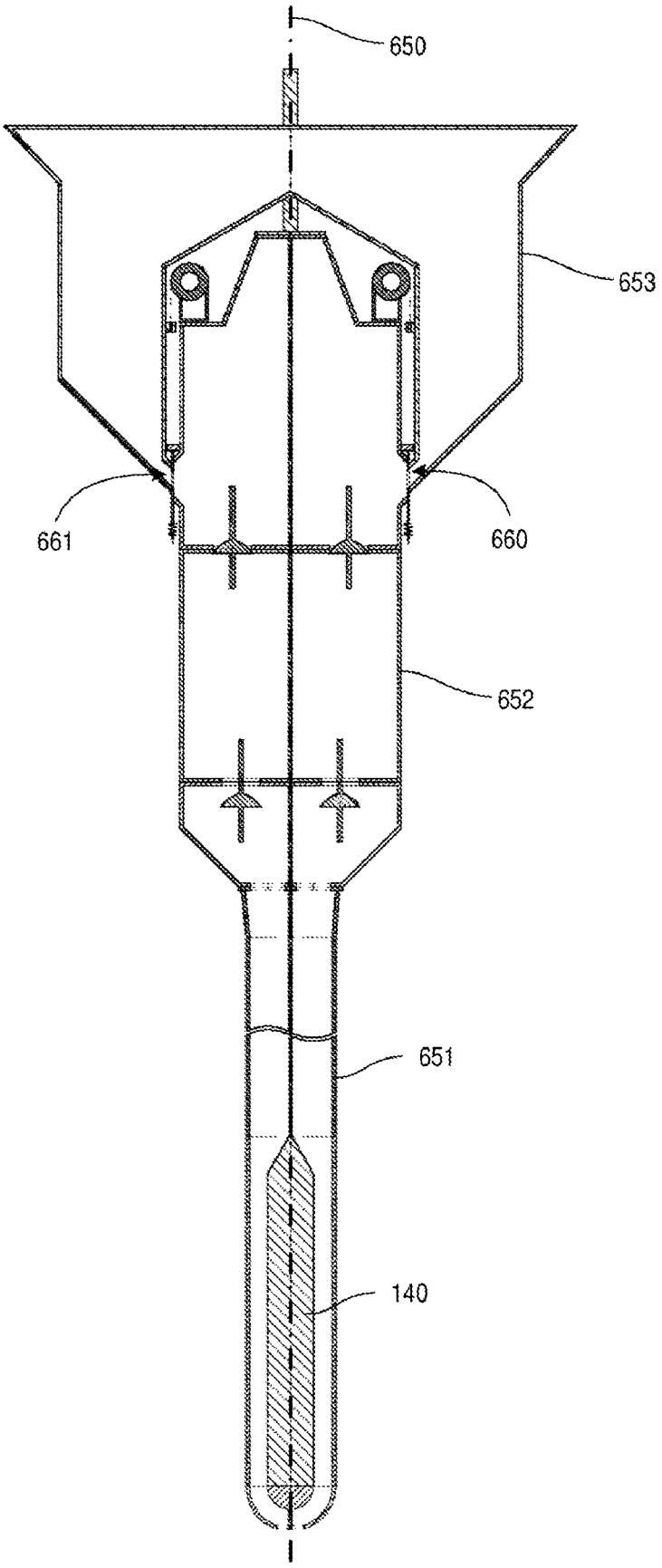
FIG. 16 shows a cut-away view of an illustrative vibrator assembly with a feed hopper, according to an embodiment of the system described herein.

FIG. 16 shows a cut-away view of an illustrative vibrator assembly with a silo pipe 651, the latter having a longitudinal axis 650. An introduction arrangement 652 may be arranged on the silo pipe 651 on a first side of the latter. The introduction arrangement 652 runs parallel to the longitudinal axis 650. The vibrator assembly may also be one of the other vibrator assemblies described.

In the example illustrated, a feed hopper 653 is located on the introduction arrangement 652 in a predefined position, in which material may flow out of the feed hopper 653 into the introduction arrangement 652. This position may be referred to as the introduction position. The feed hopper 653 may be the feed hopper 610 which has already been described. The material may flow out of the feed hopper 653 into the introduction arrangement 652 automatically, or may be delivered into the same, via at least one valve 660, wherein the valve 660 may be a slide valve with a slide plate 662. The valve 660 may also be a guillotine valve or can be referred to as such, the functional principle of the valve being similar to that of a guillotine. It may be fitted on the introduction arrangement 652 or on the feed hopper 653. If the valve 660 is fitted on the feed hopper 653, then, during operation, it also moves along therewith parallel to the longitudinal axis 650.

Figure 17:
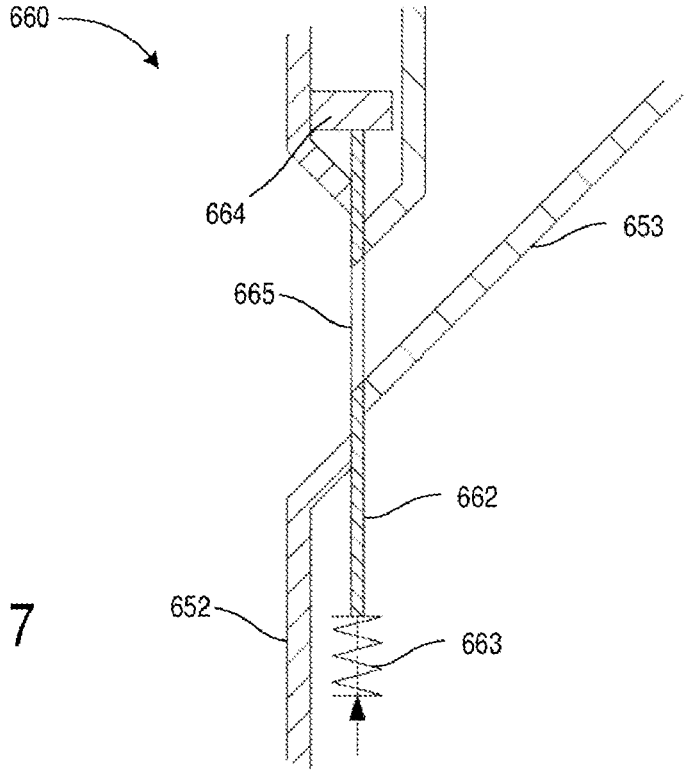
FIG. 17 shows a detail-specific view of a valve of the feed hopper in FIG. 16, according to an embodiment of the system described herein.
Figure 18:
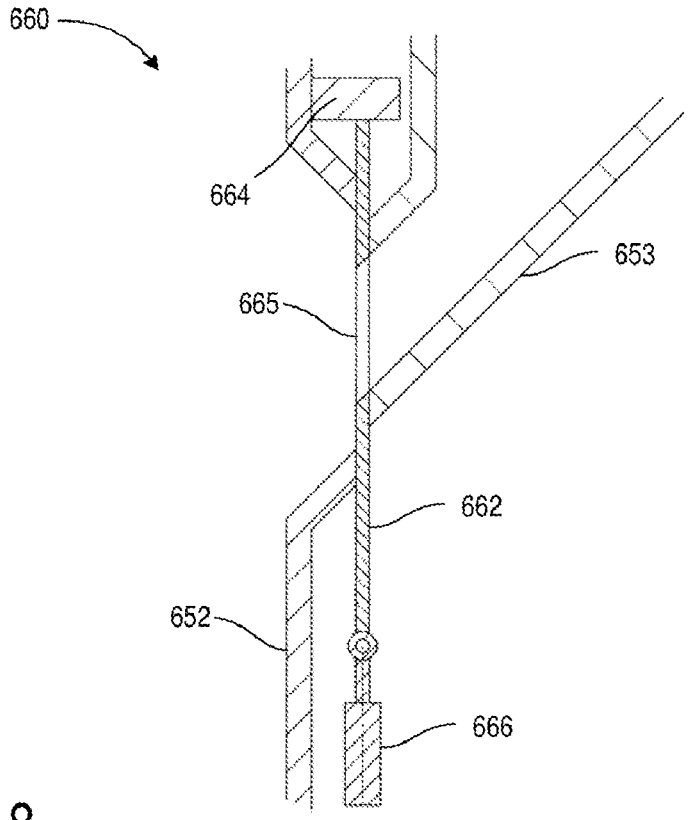
FIG. 18 shows a detail-specific view of a further illustrative valve of the feed hopper in FIG. 16, according to an embodiment of the system described herein.

FIG. 17 shows a detail-specific view of the valve 660, according to an embodiment of the system described herein. The illustration shows the valve 660 in the introduction position of the feed hopper 653. The valve 660 is therefore illustrated in the open state and material may flow out of the feed hopper 653 into the introduction arrangement 652. In the closed state, the valve 660 may be prestressed in the closing direction by the action of a spring 663. In the example illustrated, the closing direction runs parallel to the longitudinal axis 650 and away from the first end of the silo pipe 651. The spring 663 may have a first end connected to the slide plate 662 and a second end connected to the feed hopper 653. The spring 663 may have its second end mounted on the feed hopper 653. The prestressing by the spring 663 provides for reliable closure of the valve 660 as long as the feed hopper 653, rather than being located at the predefined introduction position, is moving for example along the vibrator assembly. If the feed hopper 653 is moving from the silo pipe 651 in the direction of the introduction position, then a side of the slide plate 662 which is located opposite the spring 663 is the first to butt against the introduction arrangement 652 at a stop point 664. If the feed hopper 653 then continues moving in the direction of the introduction position, the slide plate 662 is pushed counter to the action of force of the spring 663. As a result, an opening 665 in the slide plate 662 likewise moves counter to the action of force of the spring 663 and provides a through-passage for material out of the feed hopper 653 into the introduction arrangement 652. If the feed hopper 653 is moved away from the predefined introduction position, then the action of force of the spring causes the through-passage to close automatically. This is achieved by the opening 665 moving into its starting position and the slide plate 662 preventing the material from flowing out of the feed hopper 653. According to an example illustrated in FIG. 18, the slide plate 662 may also be moved via a linear drive 666. The linear drive 666 may be a hydraulic, electric or pneumatic linear drive.

Figure 19:
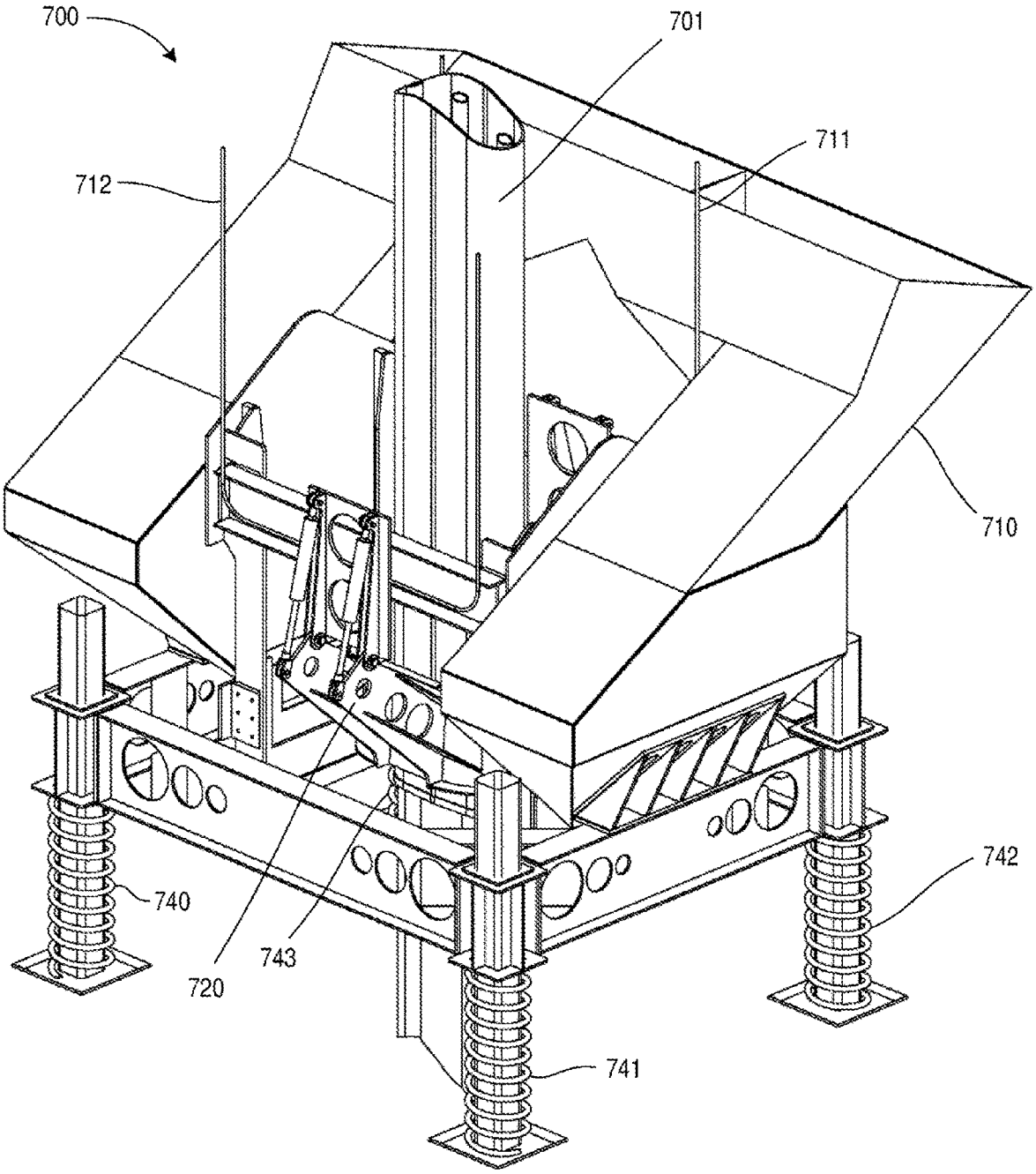
FIG. 19 shows a feed hopper with spring struts on a vibrator assembly, according to an embodiment of the system described herein.

The material in the feed hopper 653 is emptied into the introduction arrangement 652 mechanically and in automated fashion by virtue of the feed hopper 653 being displaced into the predefined introduction position. The valves 660 and 661 may be valves which are identical in terms of construction and function and may be arranged on opposite sides of the introduction arrangement 652. FIG. 19 illustrates an illustrative supply unit 700 with a silo pipe 701 and a feed hopper 710. The feed hopper 710 may be guided on the silo pipe 701 via a guide system 720 and is connected to at least one winch (not illustrated) via cables 711 and 712. The feed hopper 710 may be moved along the silo pipe 701 with the aid of the cables 711 and 712. When the feed hopper 710 is being displaced, the guide system 720 may prevent tilting of the feed hopper 710 in relation to the silo pipe 701.

The feed hopper 710 and the guide system 720 may also be connected to a framework 730. At least one spring strut may be fitted on that side of the framework 730 which is directed away from the feed hopper 710. The example illustrated shows four spring struts 740, 741, 742 and 743, which are directed onto the ground surface or onto the underlying surface which is to be worked on. When the feed hopper 710 is being displaced along the silo pipe 701, said hopper, if it has to be refilled, may be set down on the underlying surface which is to be worked on. The spring struts 740, 741, 742 and 743 are intended to cushion placement on the underlying surface which is to be worked on, and therefore to protect the vibrator assembly as a whole, and in particular the feed hopper 710, against damage. The spring struts 740, 741, 742 and 743, alongside straightforward spring struts, may also be damper-type spring struts, as a result of which vibration additionally induced by the placement operation is damped.

Figure 20:
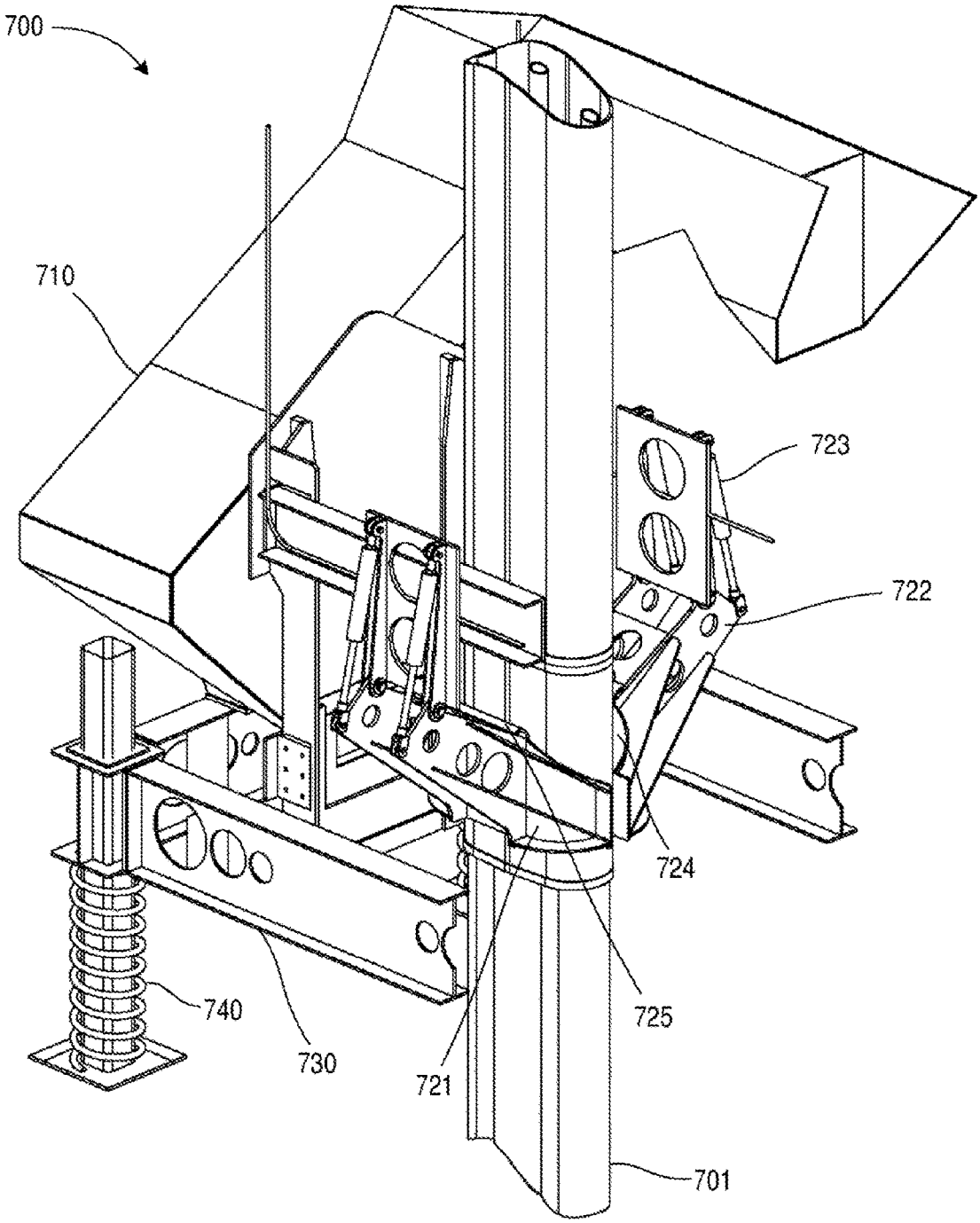
FIG. 20 shows a detail-specific view of the feed hopper in FIG. 19 with a guide means, according to an embodiment of the system described herein.

FIG. 20 shows an enlarged cut-away view of FIG. 19 according to an embodiment of the system described herein. The guide system 720 has two guide arms 721 and 722, which may each be designed in the form of double scissors-linkage mechanisms. The two guide arms 721 and 722 may be pushed against one another via springs, hydraulic linear drives or a gas-pressure damper 723 and thus each enclose half of the silo pipe 701. An opening 724 may be located between the two guide arms 721 and 722 and, in the closed state of the guide arms 721 and 722, the silo pipe 701 projects through said opening. In each case one guide roller 725 may be fitted in each case on that side of the guide arms 721 and 722 which is directed toward the silo pipe 701. Via said guide roller 725, the guide arms 721 and 722 may roll along an outer side of the silo pipe 701 when the feed hopper 710 is being displaced. The guide arms 721 and 722 may thus guide the feed hopper 710 along the silo pipe 701, or along an introduction arrangement 550 attached to the silo pipe 701, in a manner which does not induce much wear.

Figure 21A:
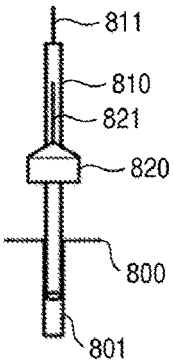
FIGS. 21A-21H show illustrative methods for filling the vibrator assembly with material.
Figure 21B:
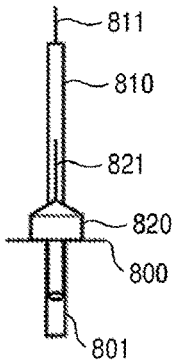
Figure 21C:
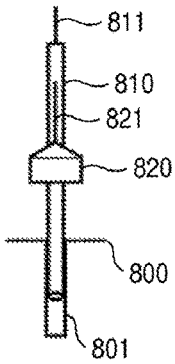
Figure 21D:
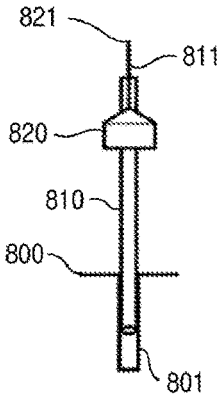

FIGS. 21A-21H illustrates illustrative methods for filling the silo pipes of the vibrator assemblies described. FIGS. 21A to 21D show method steps of a first method variant. The vibrator assembly illustrated has a silo pipe 810 and a supply unit 820, it being possible in each case for the silo pipe 810 to be connected to a crane or an excavator, and suspended thereon, via a cable 811 and for the supply unit 820 to be connected separately thereto, and suspended thereon, via a cable 821. For this purpose, a winch may be provided on the crane or excavator both for the cable 811 and for the cable 821. The suspended silo pipe 810 then may be placed on an underlying surface 800 which is to be worked on and, thereafter, a drill hole 801 may be introduced into said underlying surface. In FIGS. 21A to 21D, the silo pipe 810 may be moved constantly up and down via the cable 811, whereas the supply unit 820 may be moved relative to the silo pipe 810 independently via the cable 821. In FIG. 21A, the supply unit 820 is being lowered in the direction of the underlying surface 800. Once the supply unit 820 has reached the underlying surface 800, then the movement of the cable 821 may be stopped and the supply unit 820 may stand on the underlying surface 800 solely on account of its own weight. The supply unit 820 may be filled with new material. FIG. 21C shows how, following the filling operation, the supply unit 820 may be drawn upward again along the silo pipe 810, and away from the underlying surface 800, via the cable 821. In FIG. 21D, the supply unit 820 has arrived at its predefined introduction position on the silo pipe 810 or on the introduction arrangement attached thereto. The cable 821 here may be moved such that the supply unit 820 moves synchronously with the silo pipe 810. This may achieve synchronization between the silo pipe 810 and supply unit 820, said synchronization allowing reliable transfer of the material from the supply unit 820 into the silo pipe 810.

Figure 21E:
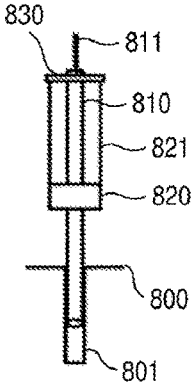
Figure 21F:
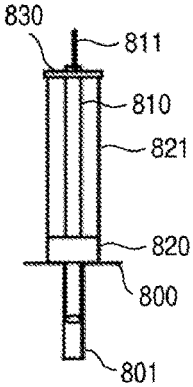
Figure 21G:
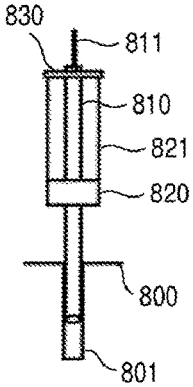
Figure 21H:
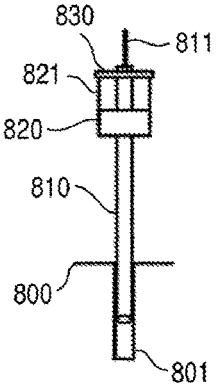

FIGS. 21E to 21H show method steps of a second method variant. In this example, the silo pipe 810 is suspended on an excavator or a crane via a cable 811. The silo pipe 810, in addition, may have a carrying frame 830, which is connected mechanically to the silo pipe 810. The supply unit 820 may be fastened on the carrying frame 830 via at least one cable 821. The supply unit 820 may be moved relative to the carrying frame 830, and thus also relative to the silo pipe 810, via the cable 821. For this purpose, at least one winch may be fitted on or in the carrying frame 830. In FIG. 21E, the supply unit 820 is being lowered in the direction of the underlying surface 800, while the silo pipe 810 is being moved up and down via the cable 811. In FIG. 21F, the supply unit 820 is standing on the underlying surface 800, while the silo pipe 810 is being moved up and down. During this method step, the cables 821 of the supply unit 820 may move anti-cyclically in relation to the movement of the silo pipe 810. This can be understood to mean that the cables 821 may be drawn up in the direction of the carrying frame 830 while the silo pipe 810 moves in the direction of the underlying surface 800. The same also applies in the reverse situation. If the silo pipe 810 moves out of the drill hole 801, then the cables 821 may be unrolled from the carrying frame in the direction of the underlying surface. In this state, the winch on the crane or excavator always moves the cable 811 counter to the direction of movement of the cable 821. In FIG. 21G, the silo pipe 810 is still moving up and down, whereas the supply unit 820 is being raised away from the underlying surface 800 via the cables 821. In FIG. 21H, the supply unit 820 has arrived at its predefined introduction position on the silo pipe 810 or on the introduction arrangement attached thereto. The movement of the cable 821 is stopped and the supply unit 820 then moves synchronously with the silo pipe 810. This achieves synchronization between the silo pipe 810 and supply unit 820, said synchronization allowing reliable transfer of the material from the supply unit 820 into the silo pipe 810. It is also the case that the silo pipe 810 is moved up and down in the drill hole during the transfer operation.

Examples of the vibrator assemblies described will be given hereinbelow.

Example 1. A vibrator assembly having a silo pipe with a longitudinal axis and with a first end and a second end; having a vibrator unit, which is coupled mechanically to the silo pipe; and having an introduction arrangement, which opens out into the silo pipe at the first end and is designed to accommodate material and direct it into the silo pipe, wherein the silo pipe has at least two separate channels running from the first end to the second end and parallel to the longitudinal axis.

Example 2. The vibrator assembly according to example 1, in which the silo pipe has at least two supply channels, which open out into in each case one of the channels and are designed to direct compressed air into the channels.

Example 3. The vibrator assembly according to example 2, in which pressure and volume flow of the compressed air can be controlled separately for each channel.

Example 4. The vibrator assembly according to one of examples 1 to 3, in which the silo pipe has three or more channels.

Example 5. The vibrator assembly according to one of examples 1 to 4, in which the at least two channels are separated from one another in a gas-tight manner.

Example 6. The vibrator assembly according to one of the preceding examples, in which the channels are separated from one another by one or more crosspieces.

Example 7. The vibrator assembly according to one of the preceding examples, in which the introduction arrangement has at least two chambers, of which each opens out in each case into one of the at least two channels.

Example 8. The vibrator assembly according to example 7, in which each of the at least two chambers has at least two valves.

Example 9. The vibrator assembly according to one of the preceding examples, also having at least one upper compressed-air infeed, which opens out into one of the at least two channels in the region of the first end of the silo pipe and is designed to direct compressed air into the interior of the one channel.

Example 10. The vibrator assembly according to example 9 having a number of upper compressed-air infeeds which corresponds to the number of channels, wherein each of the upper compressed-air infeeds opens out into in each case one of the at least two channels in the region of the first end of the silo pipe.

Example 11. The vibrator assembly according to one of the preceding examples, also having at least one lower compressed-air infeed, which opens out into one of the at least two channels in the region of a plane of the silo pipe and is designed to direct compressed air into the interior of the one channel.

Example 12. The vibrator assembly according to example 11, having a number of lower compressed-air infeeds which corresponds to the number of channels, wherein each of the lower compressed-air infeeds opens out into in each case one of the at least two channels in the region of the second end of the silo pipe.

Example 13. The vibrator assembly according to one of the preceding examples, in which the silo pipe has at least one supply channel, which runs parallel to the longitudinal axis, and in the interior, of the silo pipe.

Example 14. The vibrator assembly according to example 13, in which the at least one supply channel is designed to accommodate at least one compressed-air line or an electric line.

Example 15. The vibrator assembly according to one of the preceding examples, in which the vibrator unit is fitted at the second end of the silo pipe.

Example 16. The vibrator assembly according to one of the preceding examples, in which the at least two channels of the silo pipe have at least more or less identical surface areas in a cross-sectional plane which runs perpendicularly to the longitudinal axis of the silo pipe.

Example 17. A vibrator assembly having a silo pipe with a longitudinal axis and with a first end and a second end; having a vibrator unit, which is coupled mechanically to the silo pipe; having an introduction arrangement, which opens out into the silo pipe at the first end and is designed to accommodate material and direct it into the silo pipe; and having a supply unit, which is designed to deliver material into the introduction arrangement of the vibrator assembly, wherein the supply unit is arranged on the silo pipe or on the introduction arrangement at least such that it can move parallel to the longitudinal axis of the silo pipe.

Example 18. The vibrator assembly according to example 17, in which the supply unit is arranged on the silo pipe or on the introduction arrangement at least such that the center of gravity of the supply unit moves along the longitudinal axis of the silo pipe.

Example 19. The vibrator assembly according to example 17 or 18, also having guide elements, which guide the supply unit at least on the introduction arrangement or on the silo pipe.

Example 20. The vibrator assembly according to either of examples 17 and 19, in which the supply unit has at least one material container, which is designed to accommodate material and discharge it into the introduction arrangement.

Example 21. The vibrator assembly according to example 20, in which the at least one material container is a feed hopper.

Example 22. The vibrator assembly according to example 21, in which the feed hopper has two material cavities, which are surface-symmetrical in relation to one another and are designed such that material introduced is distributed uniformly between the two material cavities and, even in a filled state, the center of gravity of the supply unit coincides with the longitudinal axis.

Example 23. The vibrator assembly according to example 22, in which the material cavities are connected to one another via a run-off plate.

Example 24. The vibrator assembly according to example 23, in which the material cavities together with the run-off plate form a u-shaped feed hopper.

Example 25. The vibrator assembly according to one of examples 21 to 24, in which the feed hopper is designed to enclose the silo pipe or the introduction arrangement in a u-shaped or horseshoe-shaped manner.

Example 26. The vibrator assembly according to one of examples 21 to 25, in which the feed hopper is connected mechanically to a spring strut via a framework and is designed to cushion placement of the supply unit on an underlying surface which is to be worked on.

Example 27. The vibrator assembly according to example 26, in which the spring strut has a damper in addition.

Example 28. The vibrator assembly according to example 27, in which the supply unit has two guide arms, which each enclose half of the silo pipe and are designed to guide the supply unit on the silo pipe.

Example 29. The vibrator assembly according to example 28, in which the two guide arms are scissors-linkage mechanisms with gas-pressure dampers, which are designed to push the guide arms in the direction of the silo pipe.

Example 30. The vibrator assembly according to one of examples 17 to 29, in which the material containers have a closure, via which the material may be emptied at least to some extent into the introduction arrangement or the silo pipe.

Example 31. The vibrator assembly according to one of examples 17 to 30, in which the feed hopper has a closure, via which the material may be emptied at least to some extent into the introduction arrangement or the silo pipe.

Example 32. The vibrator assembly according to example 29 or 31, in which the closures are flap valves or slide valves.

Example 33. The vibrator assembly according to one of examples 29 to 32, in which, in the closed state, the closures are prestressed in the closing direction or in the opening direction under the action of force of a spring.

Example 34. The vibrator assembly according to one of examples 29 to 32, in which the closures are connected to a hydraulic, electric or pneumatic linear drive, which is designed to open and to close the closures.

Example 35. The vibrator assembly according to one of examples 17 to 34, having a carrying frame, which is connected mechanically to the introduction arrangement and has at least one winch.

Example 36. The vibrator assembly according to example 35, in which the supply unit is connected at least to the carrying frame or the introduction arrangement via the winch or the cable of the winch.

Example 37. A method for operating a vibrator assembly according to one of examples 17 to 36, having the following steps: placing the silo pipe on an underlying surface; creating a drill hole by movement of the silo pipe cyclically up and down at least on the underlying surface or in the drill hole; supplying the silo pipe with material for filling the drill hole, by way of the supply unit, wherein the movements of the supply unit along the silo pipe are controlled independently of the movements of the silo pipe.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A vibrator assembly, comprising:

a silo pipe with a longitudinal axis and with a first end and a second end;

a vibrator unit, which is coupled mechanically to the silo pipe;

an introduction arrangement, which opens out into the silo pipe at the first end and is designed to accommodate material and direct the material into the silo pipe; and a supply unit, which is designed to deliver the material into the introduction arrangement of the vibrator assembly, wherein the supply unit is arranged on the silo pipe or on the introduction arrangement at least such that the supply unit can move parallel to the longitudinal axis of the silo pipe, wherein the supply unit comprises a feed hopper, which is designed to accommodate the material and discharge the material into the introduction arrangement, wherein the feed hopper has two material cavities, which are surface-symmetrical in relation to one another and are designed such that the material introduced is distributed uniformly between the two material cavities and, even in a filled state, a center of gravity of the supply unit coincides with the longitudinal axis.

2. The vibrator assembly as claimed in claim 1, wherein the supply unit is arranged on the silo pipe or on the introduction arrangement at least such that the center of gravity of the supply unit moves along the longitudinal axis of the silo pipe.

3. The vibrator assembly as claimed in claim 1, also having: guide elements, which guide the supply unit at least on the introduction arrangement or on the silo pipe.

4. The vibrator assembly as claimed in claim 1, wherein the material cavities are connected to one another via a run-off plate.

5. The vibrator assembly as claimed in claim 4, wherein the material cavities together with the run-off plate form a u-shaped feed hopper.

6. The vibrator assembly as claimed in claim 1, wherein the feed hopper is designed to enclose the silo pipe or the introduction arrangement in a u-shaped or horseshoe-shaped manner.

7. The vibrator assembly as claimed in claim 1, wherein the feed hopper is connected mechanically to a spring strut via a framework and is designed to cushion placement of the supply unit on an underlying surface which is to be worked on.

8. The vibrator assembly as claimed in claim 1, wherein the supply unit has two guide arms, which each enclose half of the silo pipe and are designed to guide the supply unit on the silo pipe.

9. The vibrator assembly as claimed in claim 8, wherein the two guide arms are scissors-linkage mechanisms with gas-pressure dampers, which are designed to push the guide arms in the direction of the silo pipe.

10. The vibrator assembly as claimed in claim 1, wherein the at least one material container has a closure, via which the material can be emptied at least to some extent into the introduction arrangement or the silo pipe.

11. The vibrator assembly as claimed in claim 1, wherein the feed hopper has a closure, via which the material can be emptied at least to some extent into the introduction arrangement or the silo pipe.

12. The vibrator assembly as claimed in claim 11, wherein the closure is flap valves or slide valves.

13. The vibrator assembly as claimed in claim 11, wherein, in the closed state, the closure is prestressed in the closing direction or in the opening direction under the action of force of a spring.

14. The vibrator assembly as claimed in claim 11, wherein the closure is connected to a hydraulic, electric or pneumatic linear drive, which is designed to open and to close the closure.

15. The vibrator assembly as claimed in claim 1, having a carrying frame, which is connected mechanically to the introduction arrangement and has at least one winch.

16. The vibrator assembly as claimed in claim 15, wherein the supply unit is connected at least to the carrying frame or the introduction arrangement via the winch.

17. The vibrator assembly as claimed in claim 1, wherein the feed hopper is suspended at at least four outer corners of the feed hopper.

* * * * *